US006871427B2

(12) United States Patent
Muta et al.

(10) Patent No.: US 6,871,427 B2
(45) Date of Patent: Mar. 29, 2005

(54) CONSTRUCTION MACHINE AND SELF-ATTACHING AND-DETACHING METHOD THEREOF

(75) Inventors: Shigeru Muta, Akashi (JP); Kazuyuki Miyazaki, Akashi (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 39 days.

(21) Appl. No.: 10/287,660

(22) Filed: Nov. 5, 2002

(65) Prior Publication Data

US 2003/0085043 A1 May 8, 2003

(30) Foreign Application Priority Data

| | | |
|---|---|---|
| Nov. 5, 2001 | (JP) | 2001-339442 |
| Aug. 5, 2002 | (JP) | 2002-227745 |
| Aug. 16, 2002 | (JP) | 2002-237567 |

(51) Int. Cl.[7] ..... B66C 13/00
(52) U.S. Cl. ..... 37/466; 212/196
(58) Field of Search ..... 37/466, 394–397, 37/401, 403; 212/195–198

(56) References Cited

U.S. PATENT DOCUMENTS

| | | | | |
|---|---|---|---|---|
| 3,902,735 A | 9/1975 | Bertram et al. | | |
| 4,196,816 A | 4/1980 | Dvorsky et al. | ..... | 212/49 |
| 5,586,667 A | 12/1996 | Landry | ..... | 212/196 |
| 6,434,866 B1 | 8/2002 | Kawamoto et al. | ..... | 37/466 |

FOREIGN PATENT DOCUMENTS

| | | |
|---|---|---|
| JP | 3-18089 | 2/1991 |
| JP | 10-139375 | 5/1998 |
| JP | 2001-220088 | 8/2001 |
| JP | 2001-233586 | 8/2001 |
| JP | 2002-020081 | 1/2002 |
| JP | 2002-53292 | 2/2002 |
| JP | 2002-194774 | 7/2002 |

*Primary Examiner*—Christopher J. Novosad
(74) *Attorney, Agent, or Firm*—Oblon, Spivak, McClelland, Maier & Neustadt, P.C.

(57) ABSTRACT

The construction machine according to the present invention comprises a lower running body, an upper turning body mounted free to turn on the lower running body, and a connecting bracket arranged between the rear end of a turning frame of the upper turning body and a rear device arranged on the rear end side, characterized in that the connecting bracket is provided with a connecting portion connected detachably to the rear end of the turning frame, and a mounting portion for detachably mounting the rear device such as a counterweight elevating device. Thereby, the construction machine can be applied to multi-purpose uses while using the frame construction in common.

15 Claims, 24 Drawing Sheets

105
104b
107a
104
103
120
110c
106a
110
FULL STROKE LENGTH
L
S'
G. L

CONSTRUCTION MACHINE AND SELF-ATTACHING AND-DETACHING METHOD THEREOF

BACKGROUND OF THE INVENTION

1. Field of the Invention

The present invention relates to a construction machine and self-attaching and-detaching method thereof capable of coping with various applications.

2. Description of the Related Art

The construction machine has various specifications. There are illustrated types of machines requiring and not requiring a self-attachment and detachment of a counterweight (hereinafter sometimes referred to as CW), and types of machines requiring and not requiring addition of an outrigger to the rear part of a rotating frame. However, there has not been realized a construction machine such as a wheeled crane having a rotating frame that can be applied to various applications and a plurality of types of machines.

On the other hand, there have been proposed various construction machines provided with a self-assembly and disassembly device including a self-attaching and-detaching device for a CW. However, there has been posed a problem in that for example, at the time of attachment or detachment of a CW, it takes time or costs much labor in positioning thereof, resulting in the poor work efficiency.

SUMMARY OF THE INVENTION

It is an object of the present invention to provide a construction machine capable of coping with various applications and capable of making a rotating frame in common, and further to a construction machine or a self-attaching and-detaching method capable of attaching and detaching a counterweight and a rear device such as a counterweight elevating device by its own efforts without requiring an auxiliary crane.

The construction machine according to the present invention has the following constitution.

The construction machine has a lower traveling body, an upper rotating body mounted pivotedly on the lower traveling body, the upper rotating body having a rotating frame, and a connecting bracket mounted attachably and detachably on the rear end of the rotating frame, the connecting bracket having a mounting part for detachably mounting a rear device including at least one of a counterweight and a counterweight elevating device, and a connecting part for connecting detachably on the rear end of the rotating frame.

In this case, for the purpose of mounting the rear device, a counterweight different in the way of installing as mentioned later can be mounted, without providing the exclusive-use specification for the rotating frame, and where the elevating device is required for the self-attachment and detachment of a counterweight, the device can be mounted, and where an outrigger is required, the outrigger can be mounted. Thereby, a variety of types of machines different in the suspending ability or specification can be constituted using a common rotating frame.

DESCRIPTION OF THE PREFERRED EMBODIMENTS

Figure 1:
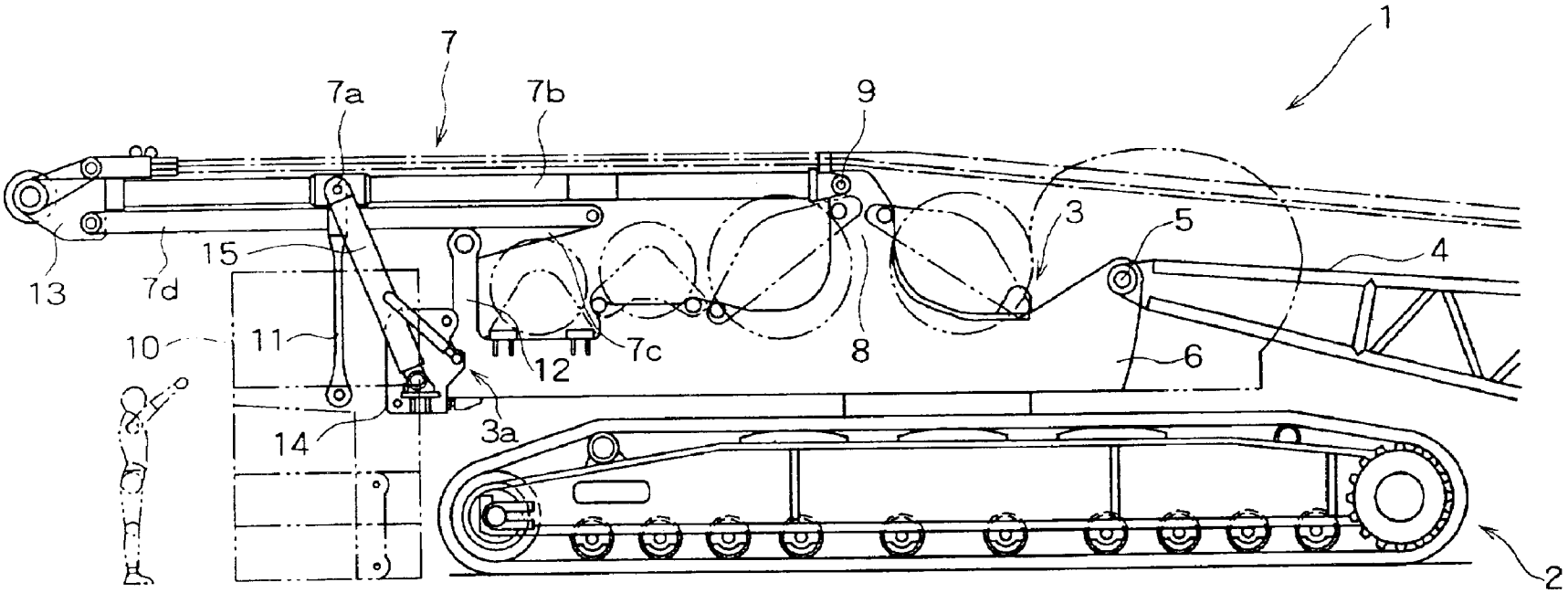
FIG. 1 is a side view of a construction of a rotating frame of wheeled crane according to one embodiment of the present invention.

The present invention will be explained hereinafter on the basis of the form of embodiment shown in the drawings. This is one form of embodiment of the present invention, not limiting thereto. In the present embodiment, a description will be made of an example of a crawler crane which is one type of a wheeled crane.

FIG. 1 shows a lower traveling body 2 of a crawler crane 1 according to the present invention and a rotating frame 3 of an upper rotating body. The rotating frame 3 is mounted pivotedly on the lower traveling body 2, in front of which is provided a boom connecting part 6 for connecting a lattice boom 4 through a boom foot pin 5.

At the rear of the boom connecting part 6 is formed a gantry support part 8 for supporting a gantry 7. A base end of a front support pillar 7*b* of the gantry 7 is connected to the gantry support part 8 through a connecting pin 9. Thereby, the gantry 7 can be raised and lowered about the connecting pin 9 as fulcrum. FIG. 1 shows the state that the gantry 7 is folded horizontally. A suspending link 11 for lifting a counterweight 10 (a first rear device) is hung down from the gantry 7.

Further, a lower tension member 12 is stood upright at the rear of the rotating frame 3. At the time of lifting work, an intermediate tension member 7*c* and an upper tension member 7*d* are connected in that order to the upper end of the lower tension member 12. The upper tension member 7*d* and the extreme end of the gantry 7 are connected through an extreme end bracket 13, so as to constitute a triangular beam as a whole.

Reference numeral 14 designates a connecting bracket connected to the rear end of the rotating frame 3, and numeral 15 designates a counterweight elevating device as a second rear device mounted on the connecting bracket 14. The elevating device can lift up for attachment or lower the counterweight for detachment.

Figure 2A:
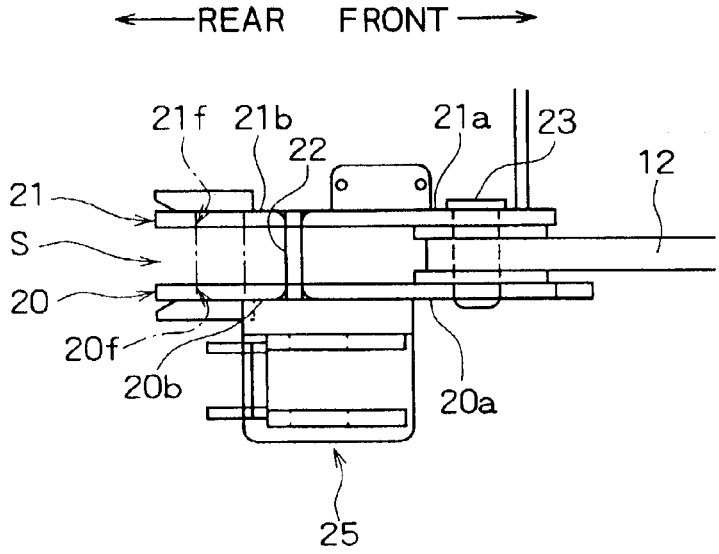
FIG. 2A is a plan view showing the constitution of a connecting bracket shown in FIG. 1.
Figure 2B:
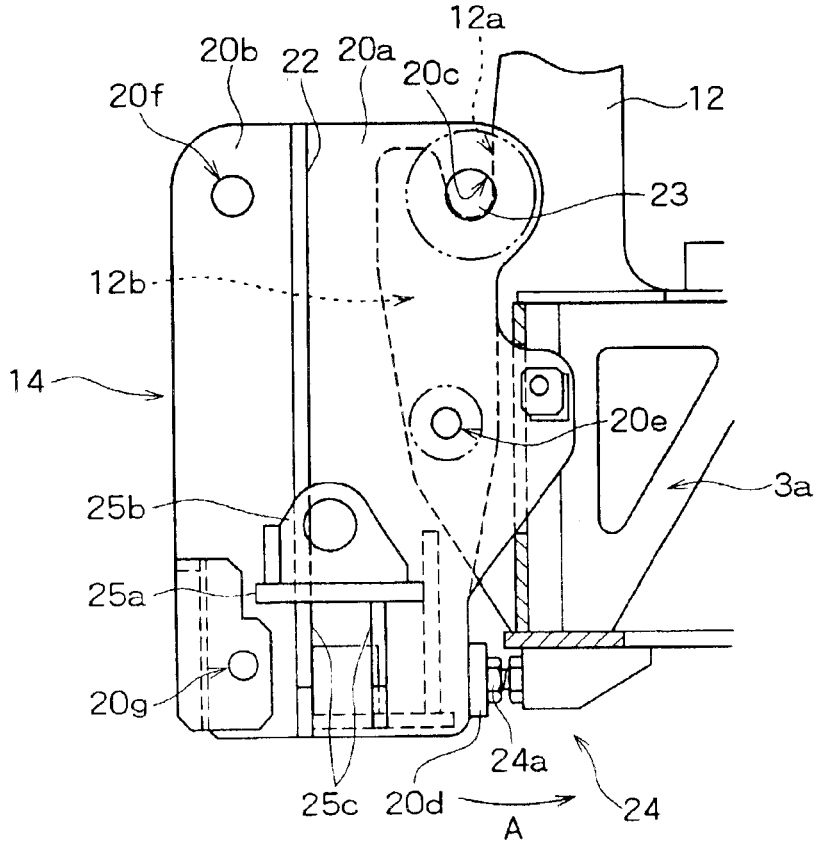
FIG. 2B is a side view thereof.

FIGS. 2A and 2B show the connecting bracket 14 in an enlarged scale, FIG. 2A being a plan view, and FIG. 2B being a side view. Here, there is shown the state that the counterweight elevating device 15 is removed.

In these figures, the connecting bracket 14 has a pair of longitudinal plate parts 20 and 21 arranged in parallel in a vertical direction, and a connecting longitudinal plate part 22 connecting the longitudinal plate parts 20 and 21 in a direction of vehicle width, these plate parts being assembled in the shape of H.

The longitudinal plate parts 20 and 21 are formed with connecting parts 20*a* and 21*a* (mainly, on the rotating frame side) and mounting parts 20*b* and 21*b* (mainly, on the side opposite the rotating frame).

At upper corners in the connecting parts 20*a* and 21*a* are formed through-holes 20*c* and 21*c* (only one on this side is shown), and a pin 23 is inserted as an engaging body into the through-holes 20*c* and 21*c*.

The pin 23 is placed in engagement with a recessed groove (a body to be engaged) 12*a* formed at the skirt on the rear side of the lower tension member 12. Accordingly, if the connecting bracket 14 is brought into engagement with the lower tension member 12 such that the skirt 12*b* of the lower tension member 12 is sandwiched between both the longitudinal plates 20 and 21, and the pin 23 mounted on the connecting parts 20*a* and 21*a* is put in the recessed groove 12*a*, the bracket 14 can be mounted on the rear end 3*a* of the rotating frame.

Reference numeral 24 designates a stopper provided on the rear end 3*a* of the rotating frame to control that the connecting bracket 14 rotates in a direction of arrow A about the pin 23 as a rotating shaft. The stopper 24 is provided with an adjusting bolt 24*a*. The attitude of the connecting bracket 14 can be adjusted vertically by rotating the bolt 24*a* clockwise or counterclockwise. Reference number 20*d* designates a pad plate on the connecting bracket 14 side opposing to the adjusting bolt 24*a*.

Further, a mounting pedestal (a counterweight mounting part) 25 for mounting the counterweight elevating device 15 is provided on the lower outer wall of the mounting part 20*b*.

The mounting pedestal 25 comprises an apron part 25*a* extending horizontally from the outer wall of the longitudinal plate part 20, a boss receiver 25*b* secured onto the apron part 25*a*, and reinforcing plates 25*c* and 25*c* fixed on the apron part 25*a* and the longitudinal plate part 20. A boss 30*a* on the tube side of the counterweight elevating device 15 is connected to the boss receiver 25*b*.

The height direction of an intermediate part in the connecting part 20*a* is bored with a through-hole 20*e* through which a fixing pin (not shown) for fixing the connecting bracket 14 to the rear end 3*a* of the rotating frame is inserted. The fixing pin is inserted through the through-hole 20*e* mainly where an outrigger described below is mounted on the connecting bracket 14, that is, where an upward load exerts on the connecting bracket 14. The fixing pin is mounted not only the aforementioned case but where the connecting bracket 14 is fixed to the rear end 3*a* of the rotating frame for safety's sake.

On the other hand, an upper corner and a lower corner of the mounting part 20*b* are bored with through-holes 20*f* and 20*g*, respectively, through which a separate fixing bolt (a fixing bolt) is inserted when the outrigger is connected.

A connecting bracket 14' having the same constitution as the connecting bracket 14 is arranged on the deep side in a direction of vehicle width. The connecting bracket 14' is also fixed to the rear end 3*a* of the rotating frame in the same fixing method as the connecting bracket 14.

In the following, the mounting construction of the rear device will be explained on behalf of the connecting bracket 14 on this side.

Figure 3:
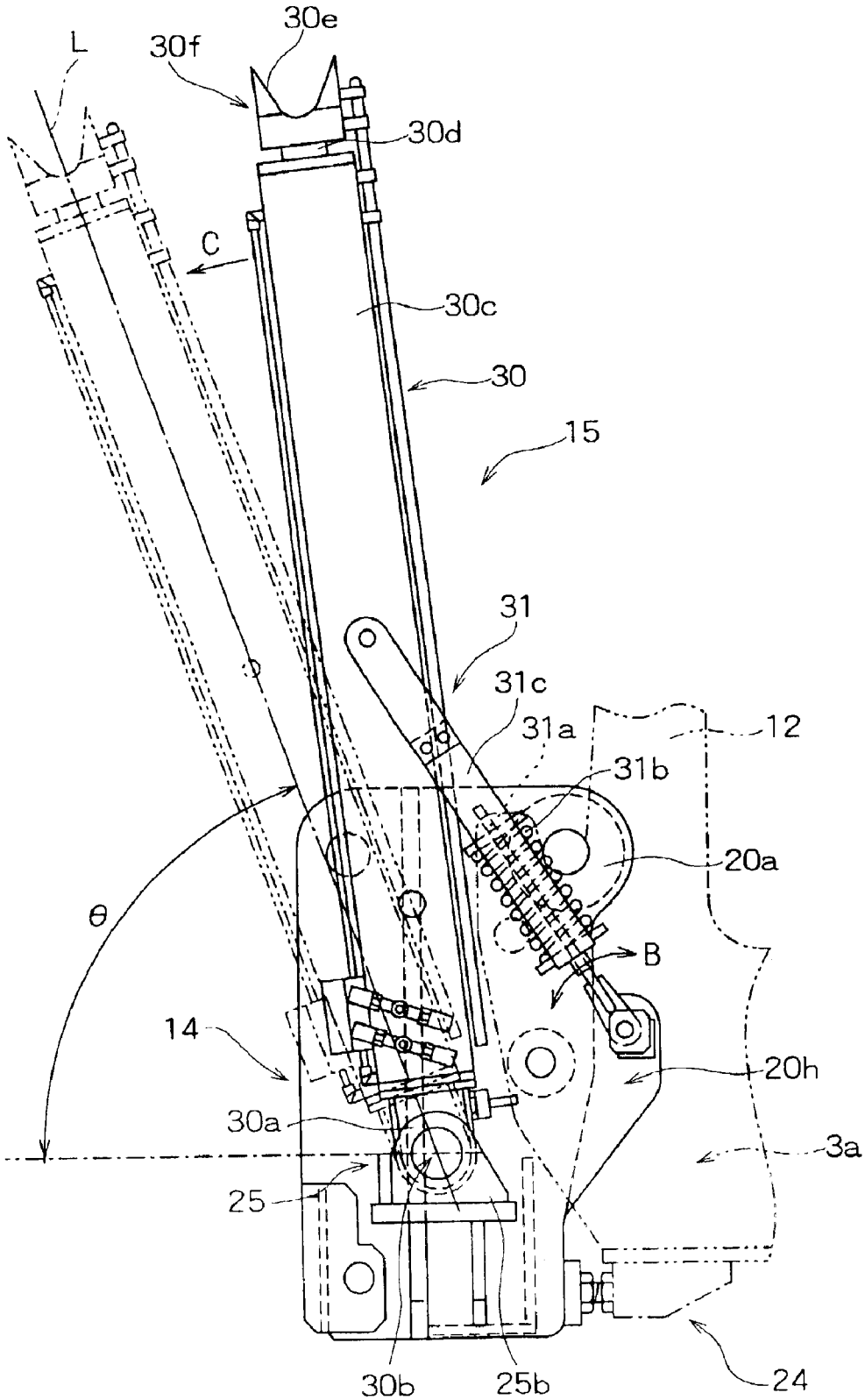
FIG. 3 is an enlarged view of a counterweight elevating device shown in FIG. 1.

FIG. 3 shows the state that the counterweight elevating device 15 is mounted on the connecting bracket 14. In the figure, the elevating device 15 has a hydraulic elevating cylinder 30. The boss 30*a* on the tube side of the elevating cylinder 30 is connected to the boss receiver 25*b* of the mounting pedestal 25 through the connecting pin 30*b*.

On the other hand, a rod 30*d* of the elevating cylinder 30 can be expanded freely, at the extreme end of which is provided an engaging bearing 30*f* provided with an engaging recessed portion 30*e* that can be engaged with engaging shafts 7*a* and 7*a* (only one on this side is shown) protruded outward in a horizontal direction each other from the gantry 7 (see FIG. 1).

Further, attitude holding device 31 for holding the attitude of the elevating cylinder 30 at a prescribed angle are mounted on the approximately intermediate part in an axial direction of the tube 30*c* and on an ear part 20*h* protruded forward from the connecting part 20*a* of the connecting bracket 14. The mounting pedestal 25 and the ear part 20*h* have the function as an elevating device mounting part.

The attitude holding device 31 comprises a shaft body 31*a* which oscillates in a direction of arrow B, a compression coil spring 31*b* secured to the extreme end of the shaft body 31*a* so as to encircle it, and a connecting metal fitting 31*c* extending in parallel with the shaft body 31*a* in the state being placed in contact with the free end side (the ear part 20*h* side) of the compression coil spring 31*b* and connected to the intermediate part of the tube 30*c*.

The attitude holding device 31 is designed so that the gantry 7 is lowered in the FIG. 1 state in the state that an engaging recessed portion 30*e* is engaged with the engaging shaft 7*a* of the gantry 7, whereby the tube 30*c* is inclined in a direction of arrow C, the compression coil spring 31*b* is compressed accordingly, and the tube 30*c* is held at a prescribed angle θ.

The prescribed angle θ is an angle at which the center of the engaging shafts 7*a* and 7*b* of the gantry 7 is positioned on the extending line of a center line L of the rod 30*d*. At this time, the counterweight elevating device 15 is in the waiting state for lifting the CW10.

Figure 4:
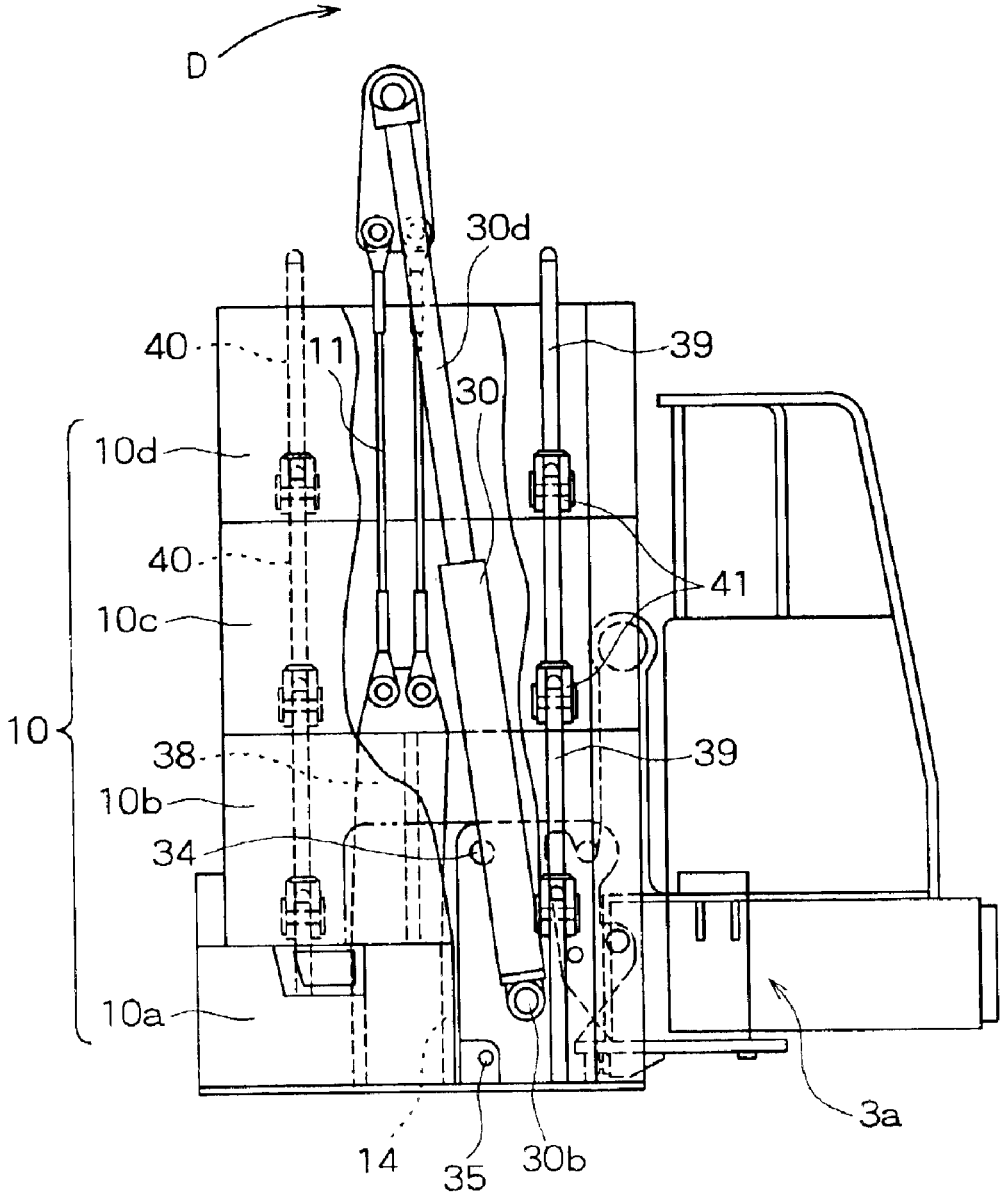
FIG. 4 is a side view showing a counterweight mounting state.
Figure 5:
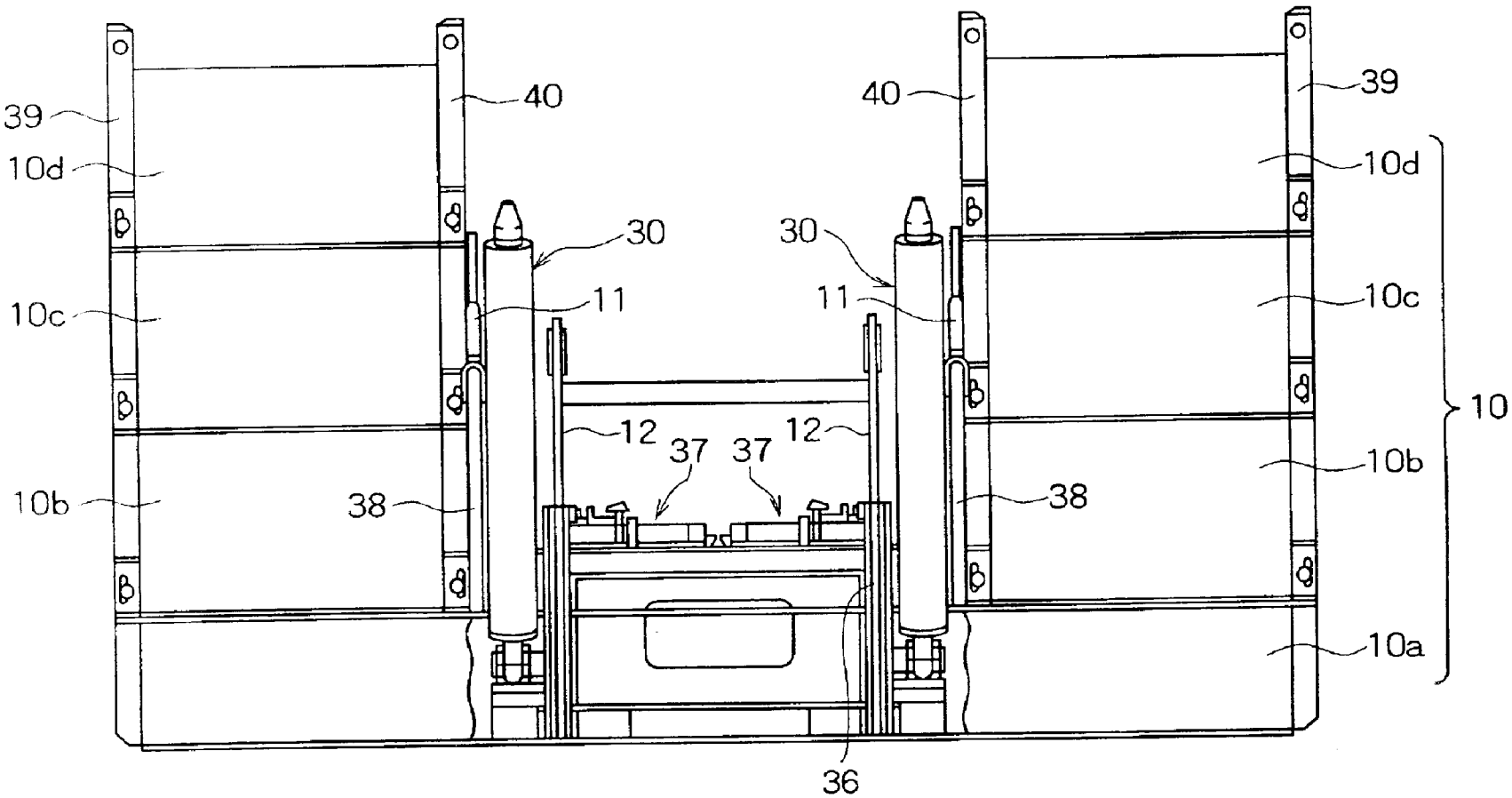
FIG. 5 is a rear view showing a counterweight mounting state.

FIG. 4 is a side view of the machine body showing the state that the CW10 is mounted on the rear end 3*a* of the rotating frame 3 through the connecting bracket 14. FIG. 5 shows the rear surface thereof.

In both the figures, the CW10 comprises a first counterweight 10*a* to a fourth counterweight 10*d* which are accumulated in four stages, and the first counterweight 10*a* is connected to the connecting bracket 14 through connecting pins 34 and 35.

More specifically, a connecting plate 36 (see FIG. 5) provided with a through-hole is stood upright on the first CW10*a*, and the connecting plate 36 is inserted in a space S (see FIG. 2A) between the longitudinal plate parts 20 and 21 of the connecting bracket 14. In this state, the connecting pin 34 is inserted into the through-hole 21*f*→through-hole of the connecting plate 36→through-hole 20*f* in that order whereby the first CW10*a* is connected to the mounting part 20*b* of the connecting bracket 14.

The connecting pin 34 is secured to the extreme end of a rod of a cylinder 37 shown in FIG. 5. Thereby, attaching and detaching of the connecting pin 34 can be automated. The connecting pin 35 is manually mounted after the connecting pin 34 has been mounted. Of course, these connecting pins 34 and 35 may be inserted automatically or manually, or only one of them may be inserted automatically.

Further, in FIG. 4, a pair of suspending plates 38 and 38 is stood upright on the first CW10*a*. The suspending link 11 is connected to the upper end of the suspending plate 38.

In the accumulated CW10*a* to 10*d*, connecting metal fittings 39 and 40 are provided vertically on the outer walls and inner walls thereof. These connecting fittings are connected together using a pin 41 whereby the accumulated CW10 are integrated as one unit.

Next, as one example of the self-attaching and-detaching method of the wheeled crane according to the present invention, the self-attaching and-detaching method of the CW10 will be explained.

The counterweights 10*a* to 10*d* are sequentially accumulated in advance in the vicinity at the rear of the wheeled crane, and the pin 41 is mounted on the connecting metal fittings 39 and 40 to be integrated as unit.

As shown in FIG. 1, the suspending link 11 is suspended above the CW10 from the gantry 7 in approximately horizontal attitude.

Then, as shown in FIG. 4, the lower end of the suspending link 11 is connected with the suspending plate 38 stood upright from the first CW10*a*.

Figure 6:
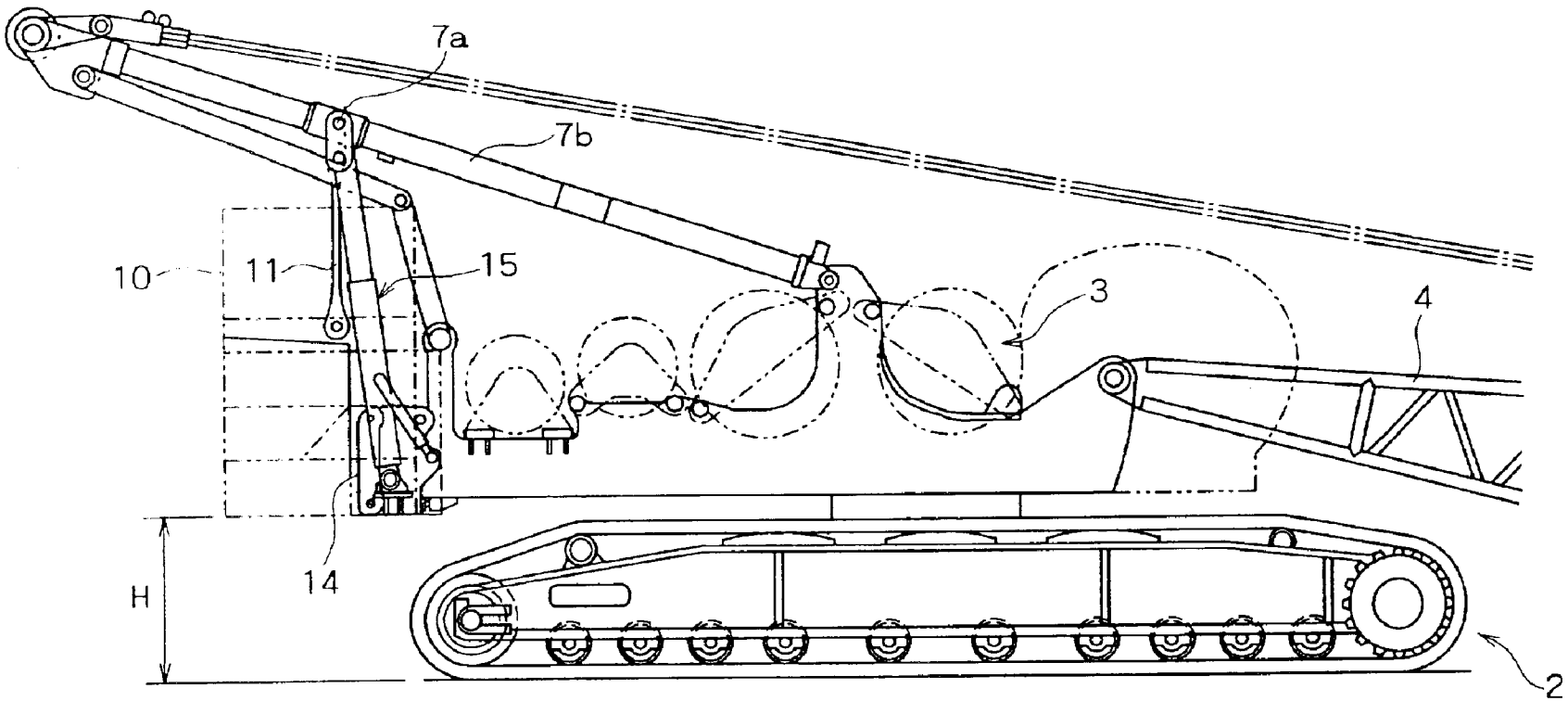
FIG. 6 is a view corresponding to FIG. 1 for explaining lifting operation of a counterweight.

Next, the rod of the counterweight elevating device 15 is extended to raise the gantry 7, and the CW10 is lifted up to the height of ground H through the suspending link 11 (see FIG. 6).

At this time, when the rod 30*d* of the elevating cylinder 30 is extended, the elevating cylinder 30 is to raise the CW10 suspended from the suspending link 11 while rotating in a direction of arrow D about the connecting pin 30*b* as fulcrum.

Then, when the elevating cylinder 30 has extended to the approximately maximum stroke, the connecting plate 36 is inserted into a space S between the longitudinal plate parts 20 and 21 of the connecting bracket 14, as mentioned previously.

Next, the connecting pins 34 and 35 are mounted whereby the CW10 is mounted on the connecting bracket 14.

The aforementioned mounting of the CW10 has been described in connection with case where the standard crane work is carried out.

Next, a description will be made of the case where the lattice boom 4 mounted on the front part of the rotating frame 3 is removed, and where an attachment (not shown) for excavation of the ground is mounted.

Where the ground excavation work is carried out, it is necessary to mount the ground excavating attachment and to project the outrigger in the direction of vehicle width at front and rear of the machine body. The front outrigger is normally provided on the attachment.

The mounting construction of the rear outrigger according to the present invention will be explained.

Figure 7:
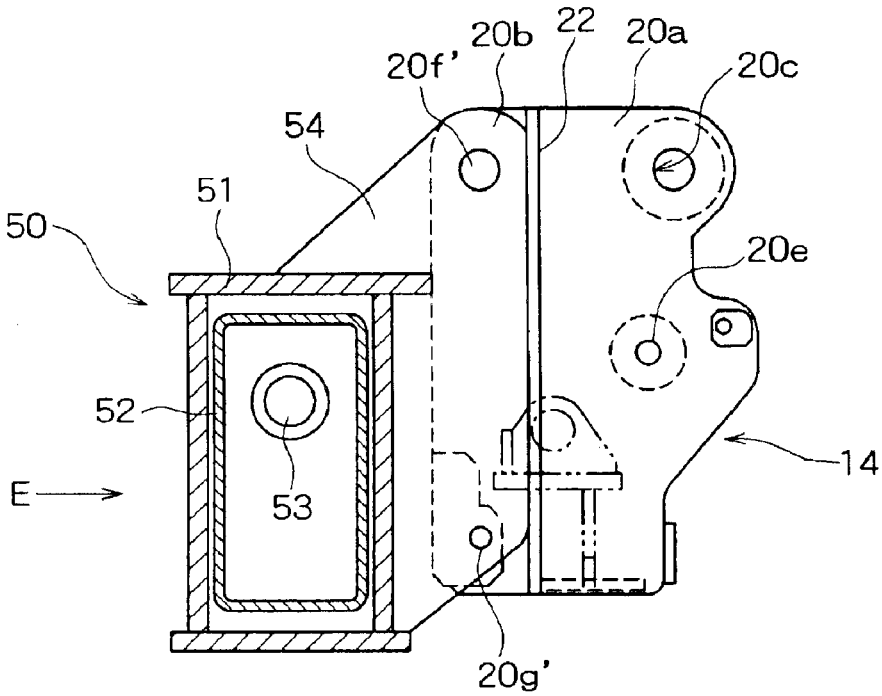
FIG. 7 is a side view showing an outrigger mounting state.

In FIG. 7, a rear outrigger 50 principally comprises an outrigger box 51, an outrigger beam 52 slidably housed in the outrigger box 51, a cylinder 53 for projecting the outrigger beam 52 in a telescopic manner or housing the same, and a connecting plate 54 for connecting the outrigger 50 having the above-described constitution to the connecting bracket 14. In the figure, with respect to the overlapped portion relative to the connecting bracket 14, the bracket 14 and the mounting pedestal 25 are indicated by the dotted line and dash dotted contour line, respectively, so as to clarify the shape of the connecting plate.

The connecting plate 54 is formed with through-holes 20*f*' and 20*g*' corresponding to the through-holes 20*f* and 20*g* formed in the longitudinal plate parts 20 and 21 of the connecting bracket 14 (see FIG. 2B). The connecting plate 54 is inserted into the space between the longitudinal plate parts 20 and 21 to come into contact with the connecting longitudinal plate part 22, the pin is inserted into the through-holes 20*f* and 20*f*', and the pin is inserted into the through-holes 20*g* and 20*g*', whereby the rear outrigger 50 can be secured to the connecting bracket 14. Where the rear outrigger 50 is mounted, the through-holes 20*f* and 20*g* of the connecting bracket 14 and the connecting longitudinal plate part 22 function as the outrigger mounting part.

Figure 8:
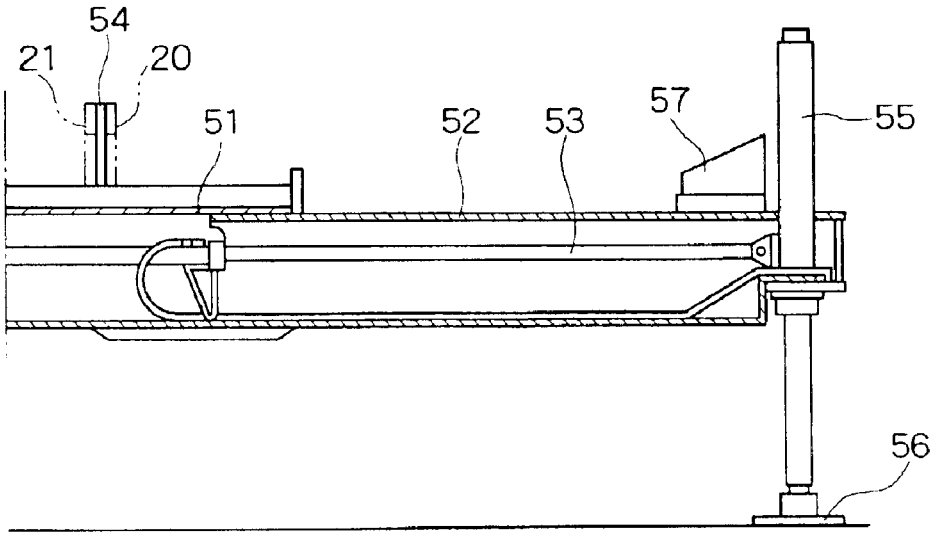
FIG. 8 is a view taken in a direction of arrow E of FIG. 7.

FIG. 8 is a view with the rear outrigger 50 of FIG. 7 viewed in the direction of arrow E. The outrigger beam 52 is shown in the state of being projected.

A jack cylinder 55 is provided vertically on the extreme end of the outrigger beam 52. The jack cylinder 55 is extended in the beam projecting state, and the machine body is raised and supported by a ground body 56 provided on the lower end thereof. Numeral 57 designates a bracket to which is connected a stay (not shown) for supporting a leader of the ground excavating attachment.

Figure 9:
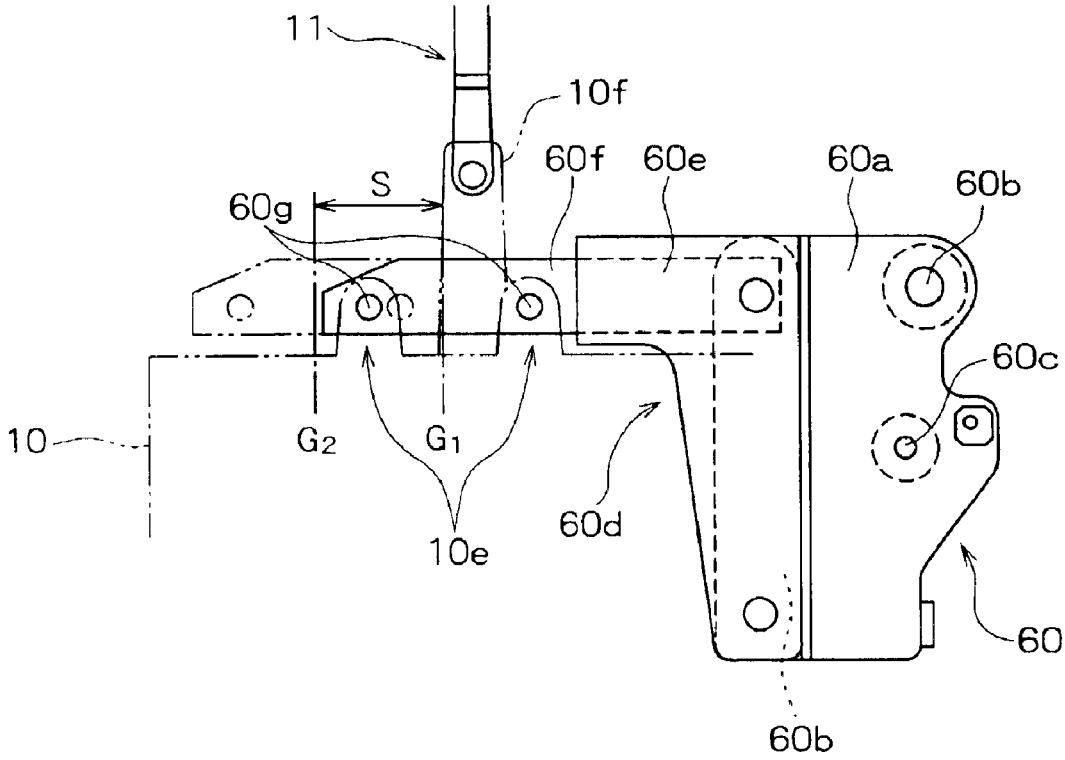
FIG. 9 is a side view showing a second embodiment of a connecting bracket according to the present invention.

FIG. 9 shows a second embodiment of the connecting bracket.

In a connecting bracket 60 shown in the figure, numeral 60*a* designates a connecting part connected detachably to the rear end of the rotating frame. The connecting part 60*a* is bored with a through-hole 60*b* for inserting a pin placed in engagement with the recessed groove 12*a* (see FIG. 2B), and a through-hole 60*c* for inserting a pin for securing the connecting bracket 60 to the rear end of the rotating frame. The constitution of the connecting part 60*a* is common to the connecting part 20*a* shown in FIG. 2B.

Numeral 60*d* designates a mounting part for detachably mounting the CW10.

The mounting part 60*d* is provided with a counterweight suspending part 60*e* for suspending the CW10. The suspending part 60*e* is provided with an expansible arm 60*f*.

The arm 60*f* is bored with two through-holes 60*g* corresponding to the suspending metal fitting 10*e* of the CW10, which can be connected with the CW10 through a bolt not shown.

Numeral 10*f* designates a suspending plate stood upright from the CW10, which is connected to the suspending link 11.

The connecting bracket 60 according to the present embodiment is mounted on the traveling crane not provided with the counterweight elevating device for attaching and detaching the CW10 by its own efforts. Accordingly, in this case, the gantry 7 for suspending the suspending link 11 is stood upright by the winch, for example.

According to the connecting bracket 60 having the above-described constitution, when the arm 60*f* is extended to withdraw the suspending position of the CW10 by length S from G1 to G2, a moment in proportion to the load of the suspending work can be increased. As a result, the suspending or lifting ability of the wheeled crane can be enhanced.

Figure 10B:
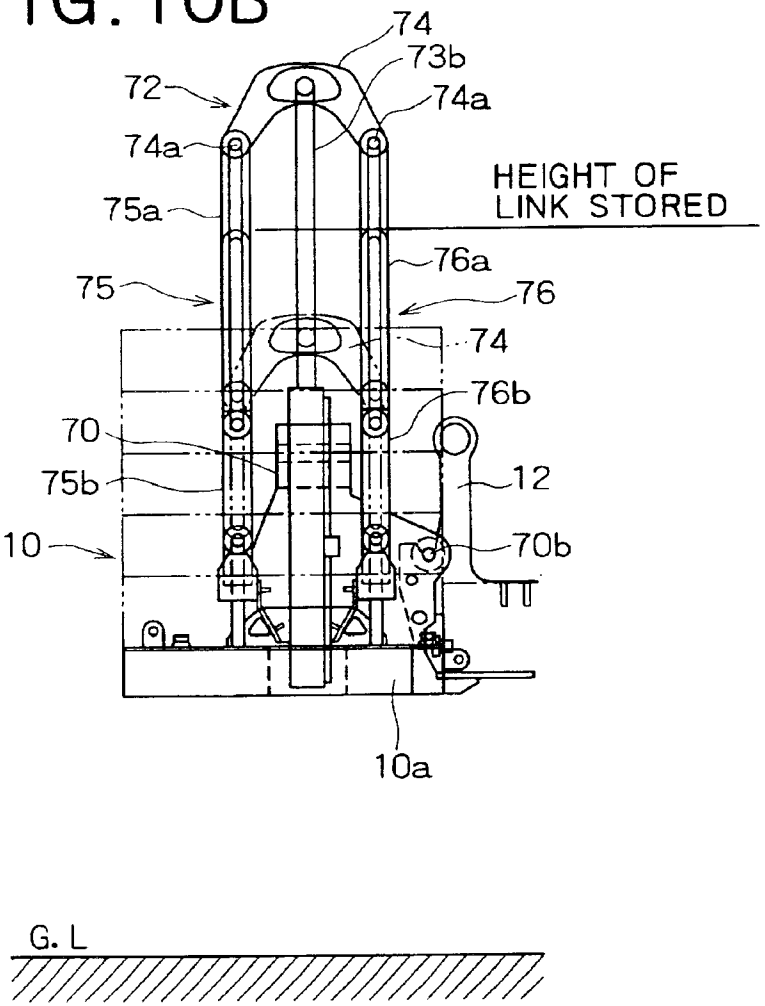
FIG. 10B is a front view showing an elevating device after lifting up a counterweight.
Figure 10A:
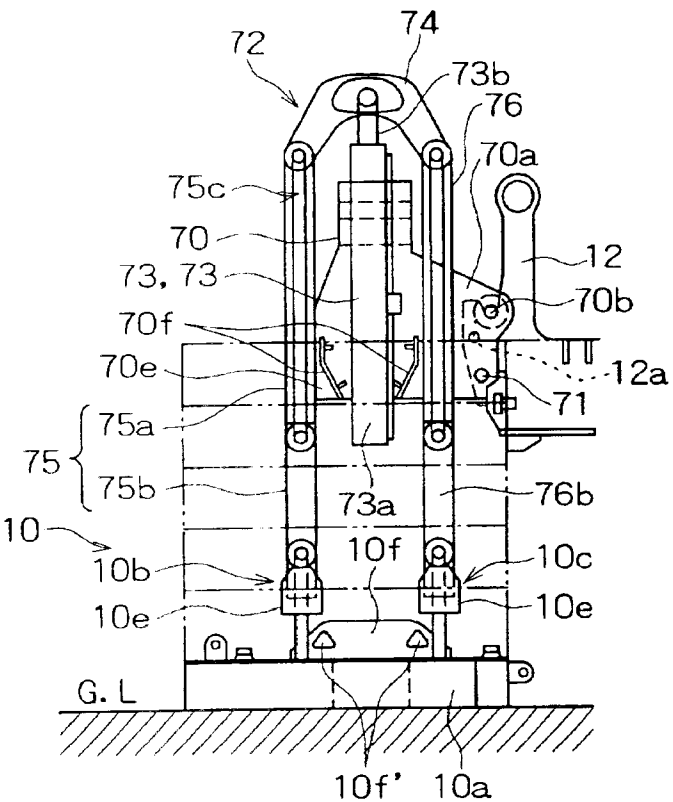
FIG. 10A is a front view showing an elevating device before lifting up a counterweight.

The connecting bracket according to a still another embodiment according to the wheeled crane of the present invention is shown in FIGS. 10A and 10B. The connecting bracket shown in the figures is constituted in order to mount a separate counterweight elevating device. FIG. 10A shows the state before the CW is lifted, and FIG. 10B shows the state that the CW is lifted. In a connecting bracket 70 shown in the figures, numerals 70*a* and 70*a* (only one on this side is shown) indicate a pair of connecting parts formed to left and right directed at the rear end of the rotating frame. A pin 70*b* mounted on the connecting parts 70*a* and 70*a* has been stopped at the recessed groove 12*a* of the lower tension member 12, after which a pin 71 is inserted to secure the connecting bracket 70 to the rear portion of the rotating frame.

Figure 11:
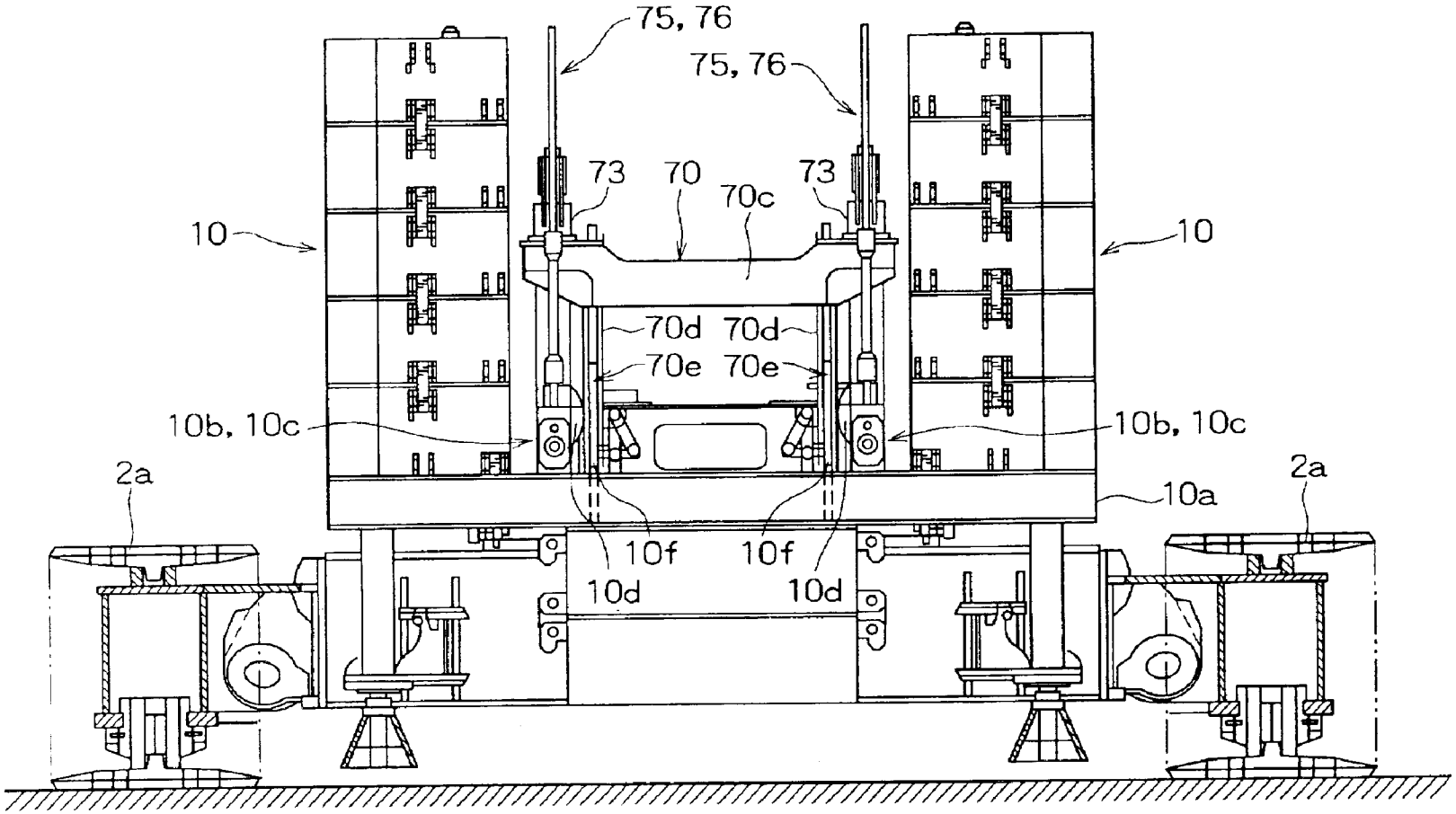
FIG. 11 is a view of a connecting bracket as viewed from backward.

The connecting bracket 70 is formed into a gate shape as shown in FIG. 11 viewing the wheeled crane from back, and comprises a horizontal frame 70*c* having a box-like section (cross section), and a pair of legs 70*d* and 70*d* suspended from both left and right sides of the horizontal frame 70*c*. In each of the legs 70*d*, two triangular plates are arranged in parallel in a lateral direction to thereby form a mounting plate housing portion 70*e*. When the counterweight is lifted, the mounting plate 10*f* (see FIG. 10A) of the CW is inserted into the mounting plate housing portion 70*e*. Hydraulic elevating cylinders 73 and 73 are mounted vertically on the end of the horizontal frame 70*c* and externally of the legs 70*d* and 70*d*, respectively. Numeral 2*a* designates a crawler.

On the other hand, in the figures, numerals 10*b* and 10*c* (only one on the rear side is shown) designate suspending metal fittings of CW. Guide plates 10*d* and 10*d* provided with an inclined surface are provided internally of the suspending metal fittings 10*b* and 10*c*. These guide plates 10*d* are provided to guide so that the suspending metal fittings 10*b* and 10*c* are lifted along the outer surface of a mounting plate housing portion 70*e*.

Further, suspending metal fittings guides 70*f* and 70*f* are provided backward and forward, corresponding to the guide plates 10*d* and 10*d*, as shown in FIG. 10A, on the outer surface of the mounting plate housing portion 70*e* in which the guide plates 10*d* slidably move. The pair of the suspending metal fittings guides 70*f* and 70*f* comprise band plate members whose lower portion is in a V shape and upper portion is vertical. Thereby, in lifting the CW10, the suspending metal fittings 70*f* and 70*f* are positioned during upward movement thereof along the V-shaped portion of the suspending metal fittings guides 70*f* and 70*f* even if the positions thereof are somewhat deviated in a lateral direction, and finally, they are held by the vertical portion.

A counterweight self-attaching and-detaching device 72 have elevating cylinders 73, 73 (only one on this side is shown), a balance-like connecting fitting 74 is provided on the extreme end of a rod 73*b* extended upward from the elevating cylinder 73, and two links 75 and 76 are suspended backward and forward from the connecting fitting 74.

In the link 75, a lengthy upper link 75*a* and a lower link 75*b* formed to be shorter than the link 75*a* are connected through a pin. The upper link 75*a* is formed with a slot 75*c* in which the pin may be slidably moved. Accordingly, the link 75 can be extended and contracted in a vertical direction. The link 76 has the same constitution as that of the link 75.

Suspending metal fittings 10*b* and 10*c* are provided on the upper surface of a base 10*a* of CW. The suspending metal fitting 10*b* and the suspending metal fitting 10*c* are connected to the lower link 75*b* and the lower link 76*b*, respectively. Mounting plates 10*f* formed of a convex are disposed to left and right on the upper surface of the base 10*a* (internally of the suspending metal fitting 10*c*). Each mounting plate 10*f* is provided with a triangular hole 10*f'* backward and forward. If the CW10 is lifted to the mounting position at the rear of the upper rotating frame, and a mooring pin described later is inserted into the triangular hole 10*f'* of the mounting plate 10*f* and an engaging hole 70*e* formed in the connecting bracket, the base 10*a* and the connecting bracket 70 are fixed.

When the rod 73*b* of the elevating cylinder 73 is extended after the lower links 75*b* and 76*b* have been connected to the suspending metal fittings 10*b* and 10*c*, the counterweight 10 is lifted in a stable manner through four links 75 and 76 (only two links on this side are shown), as shown in FIG. 10B. After the base 10*a* has been secured to the connecting bracket 70 using a mooring pin, the rod 73*b* of the elevating cylinder 73 is housed (contracted) to thereby terminate the self-mounting of the CW10.

The pin 74*a* of the connecting fitting 74 is designed so as to be slidably moved within the grooves of the upper links 75*a* and 76*a*. Because of this, when the rod 73*b* of the elevating cylinder 73 is contracted, the upper links 75*a* and 76*a* move down to the housing height, and the connecting fitting 74 moves down to the position indicated by the dash-dotted contour line.

From the foregoing, preferably, as means for securing the CW to the connecting bracket, the engaging hole for connecting the connecting bracket is provided in the CW, the mooring pin is provided, corresponding to the engaging hole, on the counterweight mounting portion of the connecting bracket, and there are provided s link mechanism for inserting the mooring pin into the engaging hole or removing it therefrom, and an operating unit for operating the link mechanism on the ground. In this case, in mounting the CW on the rear device, inserting or removing (fixing or releasing) the mooring pin through the link mechanism from the ground by an operator can be operated.

Further, in the self-attaching and-detaching method of a wheeled crane for attaching and detaching the connecting bracket on which the counterweight elevating device provide with the expansion cylinder is mounted to the rear end of the rotating frame, it is recommended that the upper end of the expansion cylinder and the CW are connected by the link member, and the expansion cylinder is extended whereby the CW is moved up to the mounting portion of the connecting bracket through the link member, and the CW and the connecting bracket are connected.

In this case, the CW can be connected with the connecting bracket quickly in a stabilized attitude.

Figure 12:
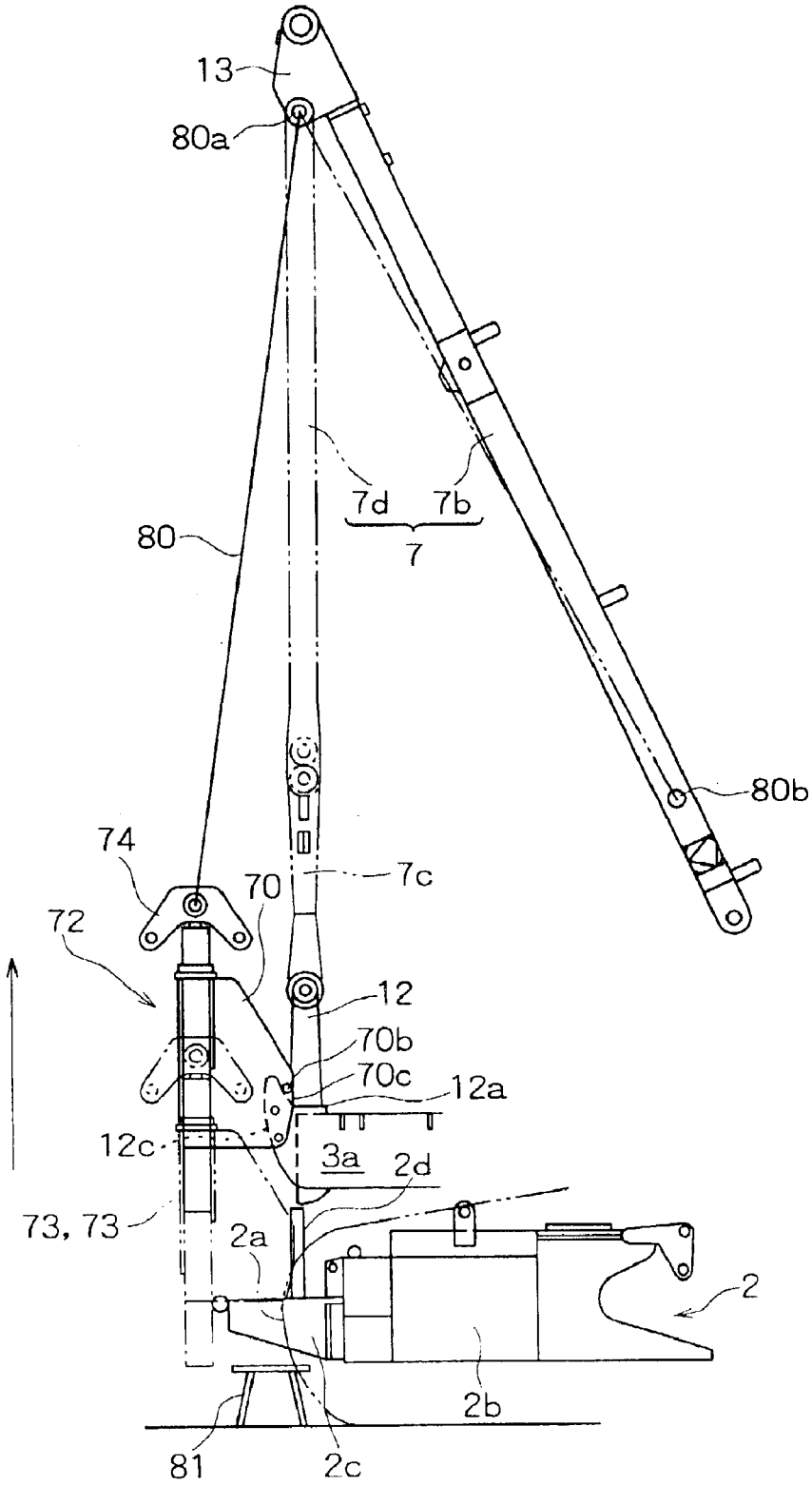
FIG. 12 is a side view showing a first attaching and detaching method of a rear device unit.

FIG. 12 shows a method for mounting the connecting bracket (hereinafter called a rear device unit) with the counterweight self-attaching and-detaching device by own efforts.

A car body weight 2*b* is sometimes mounted on the lower frame for connecting widthwise crawler frames of crawlers 2*a* provided on both left and right sides of the lower traveling body 2. The rear device unit for separately transporting the CW without putting it on the ground using a temporarily putting bracket 2*c* of the car body weight 2*b* is temporarily put on the crane body to thereby enable carrying out a positioning thereof under the easier conditions.

For carrying out the temporary putting of the rear device unit by own efforts, a winch mounted on the wheeled crane with the upper rotating body turned by 180° is used. That is, a winch rope is stretched over a sheave provided on the upper end of the basic boom, and the rear device unit is lifted by a hook at the lower end of the rope to thereby lift the unit up to the temporary putting position.

Numeral 7*b* designates a front support pillar of the gantry, and numeral 7*c* designates a rear support pillar. This gantry 7 is normally stood upright by an exclusive-use hydraulic cylinder not shown.

Further, where the rear device unit is lifted, first, the rear device unit is placed on the temporary putting bracket 2*c* by the aforementioned method. A pair of guide pillars 2*d* serving as a stopper and a guide at the time of elevating are stood upright on the temporary putting bracket 2*c* so as to facilitate positioning when the unit is temporarily put by own efforts. This temporarily putting bracket 2*c* can be the constitution in which it may be detachably mounted on the existing car body weight.

By making use of the thus constituted temporarily putting bracket 2*c*, the unstabilized rear device unit having the elevating cylinder 73 projected downward can be held stably without being affected by the concavo-convex slots of the ground and positioned.

Further, for the front support pillar 7*b* of the gantry 7 as a support body, a rope 80 for lifting the rear device unit is prepared in advance along the side of the support pillar. An upper end 80*a* of the rope 80 is connected to the extreme end 13 as a portion to be engaged, and a lower end 80*b* thereof can be mounted detachably on the side of the front support pillar 7*b*. In the state that the lower end 80*b* is removed from the front support pillar 7*b*, the rope 80 can be oscillated backward and forward about the upper end 80*a*.

The elevating cylinder 73 can be connected to a hydraulic source (not shown) provided on the rear end of the upper rotating body, and the elevating cylinder 73 can be expanded by a remove controller from places other than the cabin.

First, the upper rotating body is turned by 180° in order to return the rear end 3 of the rotating frame backward so as not to interfere with the connecting bracket 70 placed on the temporary putting bracket 2*c*, and the lower end 80*b* of the rope 80 is removed from the front support pillar 7*b* before the gantry 7 is raised. Then, the gantry 7 is stood upright at a fixed angle so that the extreme end 13 of the gantry 7 is positioned on the axis of the elevating cylinder 73. In this condition, the elevating cylinder 73 is extended at maximum, and the lower end 80*b* of the rope 80 is connected to the connecting fitting 74 on the upper end of the elevating cylinder 73. Subsequently, the elevating cylinder 73 is gradually contracted whereby the rear device unit is moved up along the guide pillar 2*d*. Successively to the guide pillar 2*d*, the unit is moved up along the rear end 12*c* of the lower tension member 12, and finally, the pin 70*b* of the connecting bracket 70 is guided to the recessed groove 12*a*.

It is noted that where the rear device unit is detached, work is to be carried out in the process reversed to that mentioned above.

The rear device unit can be lifted merely by the erecting operation of the gantry 7. At this time, the rear device unit is made to assume a backwardly inclined attitude by adjusting a suspending position of the rope 80, and a front edge 70*c* of the bracket 70 is lifted while slidably moving along a rear edge 12*c* of the lower tension member 12. When the pin 70*b* of the connecting bracket 70 is lifted to the height exceeding the rear edge 12*c*, the elevating cylinders 73 and 73 are somewhat extended, and the pin 70*b* is moored at the recessed groove 12*a*. Thereafter, the rear device unit is secured to the rear end 3*a* of the rotating frame using a fixing pin.

From the foregoing, preferably, a portion to be engaged such as a recessed groove with which the connecting bracket is engaged is provided on the rear end of the rotating frame, and an engaging body, for example, such as a pin with which the portion to be engaged is engaged is provided on the end of the rotating frame side of the connecting bracket. In this case, the pin of the connecting bracket is merely engaged with the recessed groove at the rear end of the rotating frame to enable connecting the connecting bracket with the rotating frame.

On the other hand, where the rear device unit is moved down, conversely to the above, first, the elevating cylinders 73 and 73 are connected to the lower end of the rope 80 in the state that they are somewhat extended. Thereafter, by somewhat contracting them, the pin 70*b* is removed from the recessed groove 12*a*. Then, the elevating cylinders 73 and 73 are extended at maximum, whereby the rear device unit is moved down and lowered down on the ground.

Where the car body weight 2*b* is not used, a base 81 for placing the bracket 70 with an attaching and detaching device may be prepared. The base 81 is provided with a contact reference portion for placing in contact with a crawler frame so as to be arranged with the crawler frame of the crawler 2*a* of the lower traveling body as a reference, and a notch portion to be a positioning reference when the rear device unit is temporarily placed.

Figure 13:
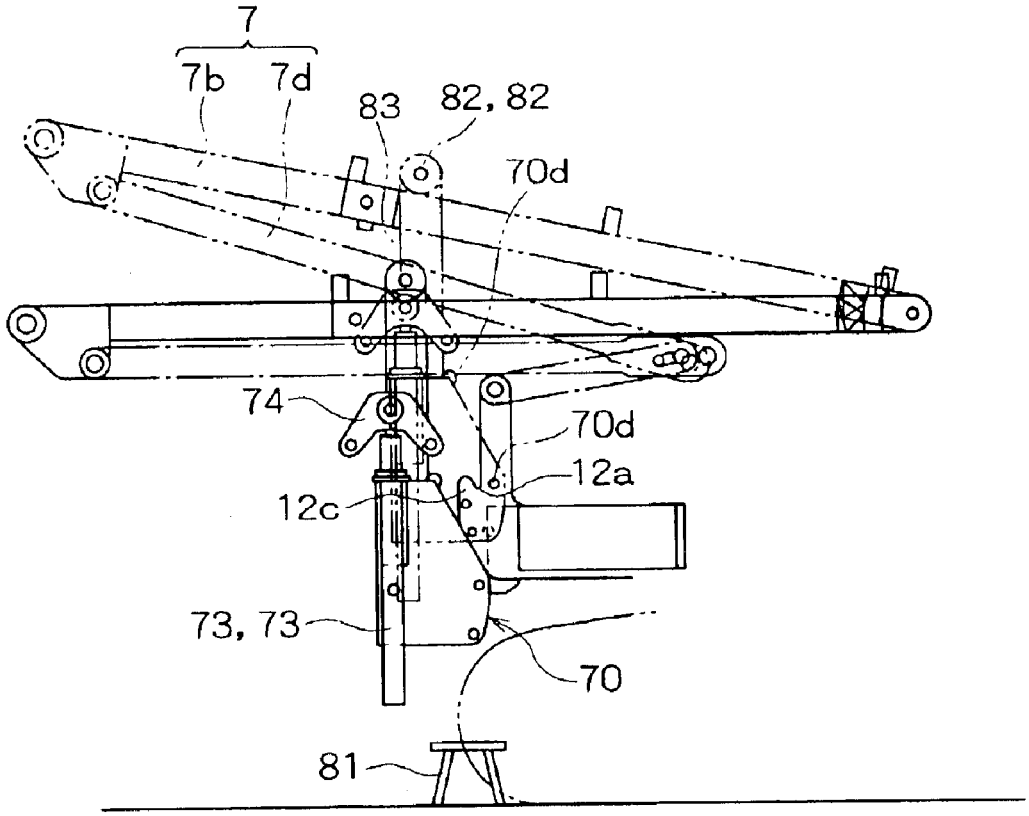
FIG. 13 is a side view showing a second attaching and detaching method of a rear device unit.

FIG. 13 shows a method for lifting the rear device unit, by own efforts, through a sheave (a part to be engaged) 82 provided on the gantry 7 as a support body. In the following description, the same constituent elements as those shown in FIG. 12 are indicated by the same reference numerals, description of which is omitted.

In FIG. 13, in the front support pillar 7*b* of the gantry 7, there is disposed a pair of sheaves 82 and 82 (only one on this side is shown) to left and right. The sheaves 82 and 82 are mounted upwardly of the rear device unit placed on the base 81.

Where the rear device unit is lifted, first, the elevating cylinders 73 and 73 are extended at maximum. Then, one end of the rope 83 is connected to the connecting fitting 74 of the elevating cylinder 73, the rope 83 is stretched over the sheave 82, and the other end thereof is connected to the upper end portion 70*d* of the connecting bracket 70. In this condition, the elevating cylinders 73 and 73 are gradually contracted. Then, the gantry 7 is somewhat stood upright, and the rear device unit is drawn close to the rear portion of the upper rotating body. Upon assurance of the fact that the bar 70*b* of the bracket 70 is lifted to the height exceeding the upper end of the rear edge 12*c*, the elevating cylinders 73 and 73 are somewhat extended, and the bar 70*b* is stopped at the recessed groove 12*a*.

According to the aforementioned method, even in the state that the gantry 7 is not stood upright, the self-mounting of the rear device unit can be carried out.

Figure 14A:
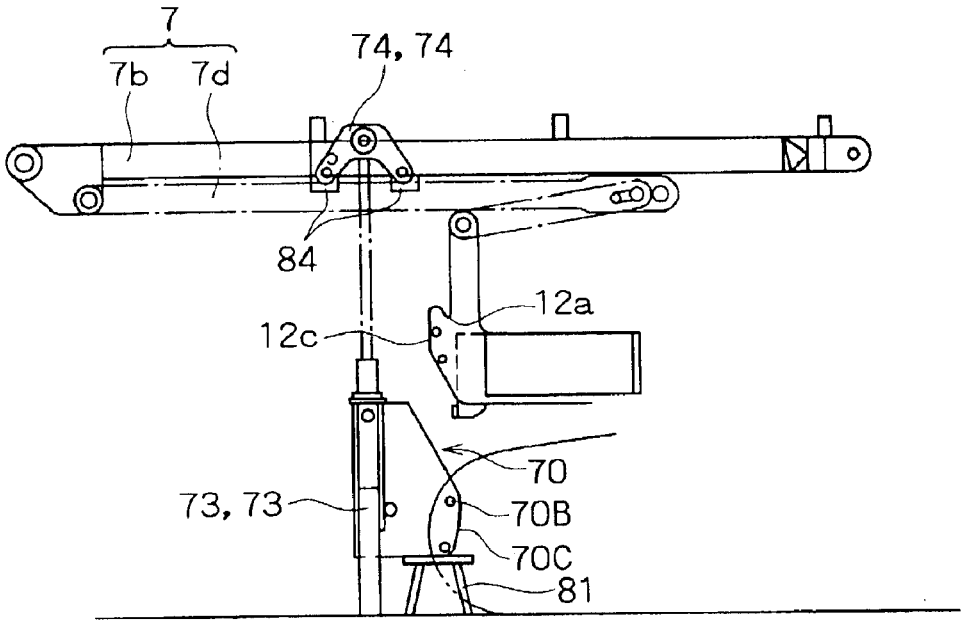
FIGS. 14A and 14B respectively show a third attaching and detaching method of a rear device unit, FIG. 14A being a side view before lifting, FIG. 14B being a side view after lifting.
Figure 14B:
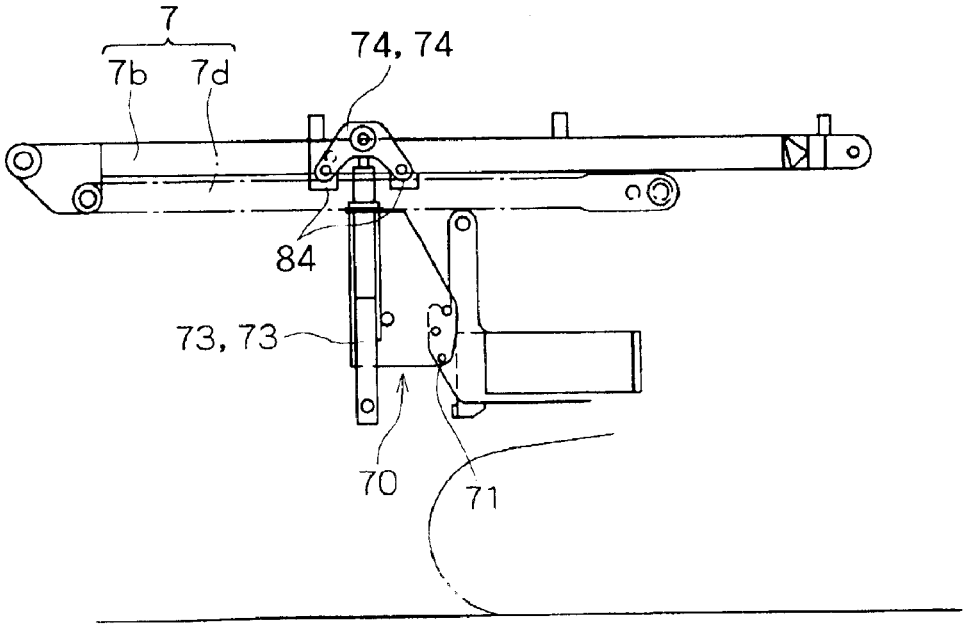

FIGS. 14A and 14B show a method for lifting the rear device unit merely by the elevating cylinders 73 and 73 without using a rope and a sheave. In FIG. 14A, in the front support pillar 7*b* of the gantry 7 as a support body, a pair of fixing portions (portions to be engaged) 84 and 84 (only one on this side is shown) for connecting the connecting fittings 74 and 74 of the elevating cylinders are disposed to left and right.

Where the rear device unit is lifted, first, the rear device unit is placed on the base 81 to carry out positioning. Then, the rods of the elevating cylinders 73 and 73 are extended, and the connecting fitting 74 is moved up till reaching the fixing portions 84 and 84. Next, the connecting fitting 74 and the fixing portions 84 and 84 are connected using the pin.

Next, the rods of the elevating cylinders 73 and 73 are contracted to thereby lift the rear device unit. When the bar 70*b* of the bracket 70 is lifted to the height exceeding the upper end of the rear edge 12*c,* the elevating cylinders 73 and 73 are somewhat extended, and the bar 70*b* is stopped at the recessed groove 12*a.*

FIG. 14B shows the state that the rear device unit is mounted on the rear portion of the upper rotating body, and the pin 71 is inserted. In this state, the pin by which the connecting fitting 74 and the fixing portions 84 and 84 are connected is removed.

Figure 15:
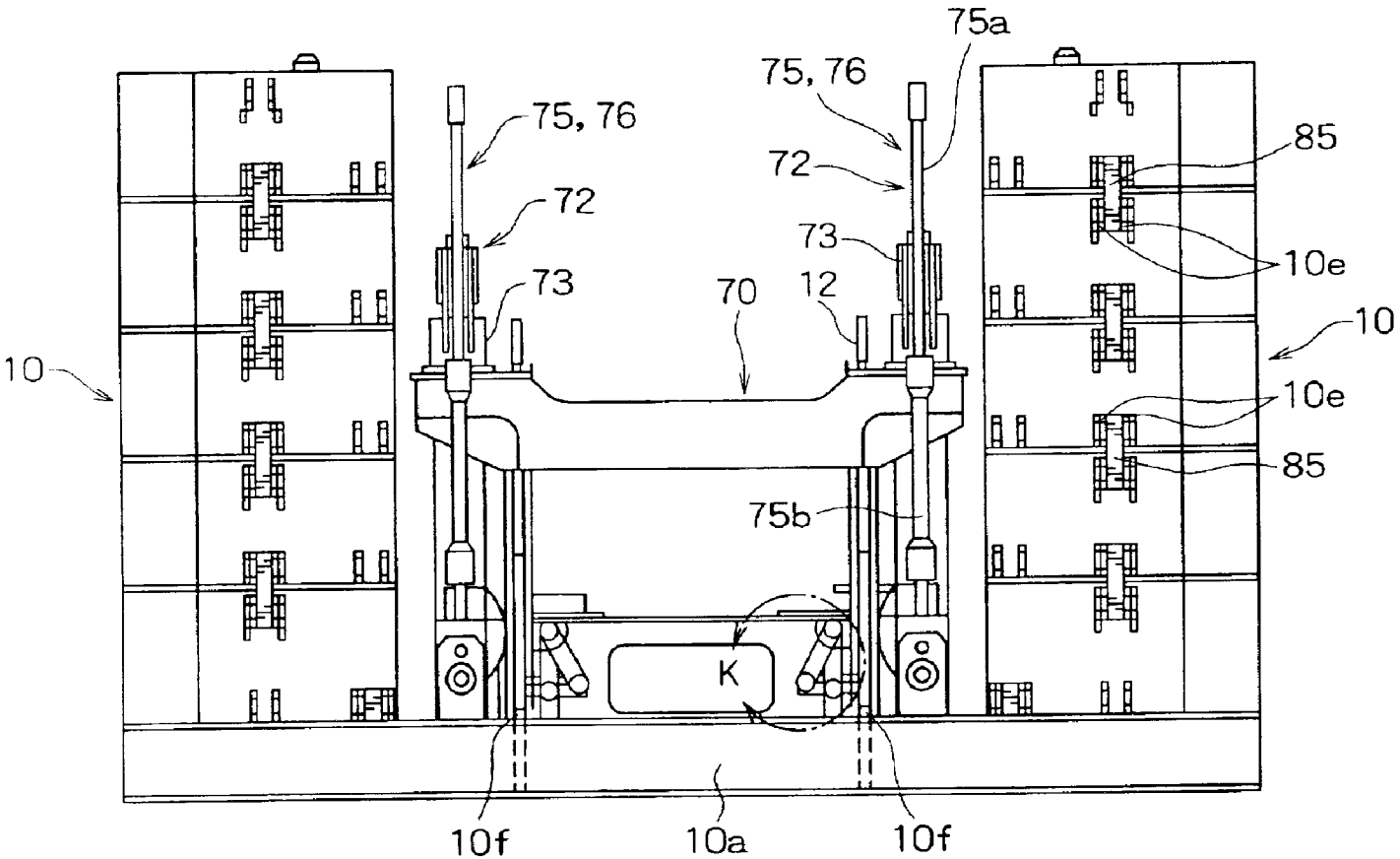
FIG. 15 is a rear view showing a counterweight mounting state.

FIG. 15 shows the loading work state of CW. This figure shows an arrangement of the counterweight self-attaching and-detaching apparatus 72 and the connecting bracket 70 where the CW10 is lifted with the wheeled crane viewed from the back. In the figure, the CWs 10 are arranged in a accumulated state on both left and right sides of the counterweight self-attaching and-detaching apparatus 72. In the front surface and rear surface of the CWs 10 in each stage, the, connecting fittings 10*e* are disposed in row in a longitudinal direction, the connecting fittings 10*e* are connected with a connecting plate 85.

Figure 16:
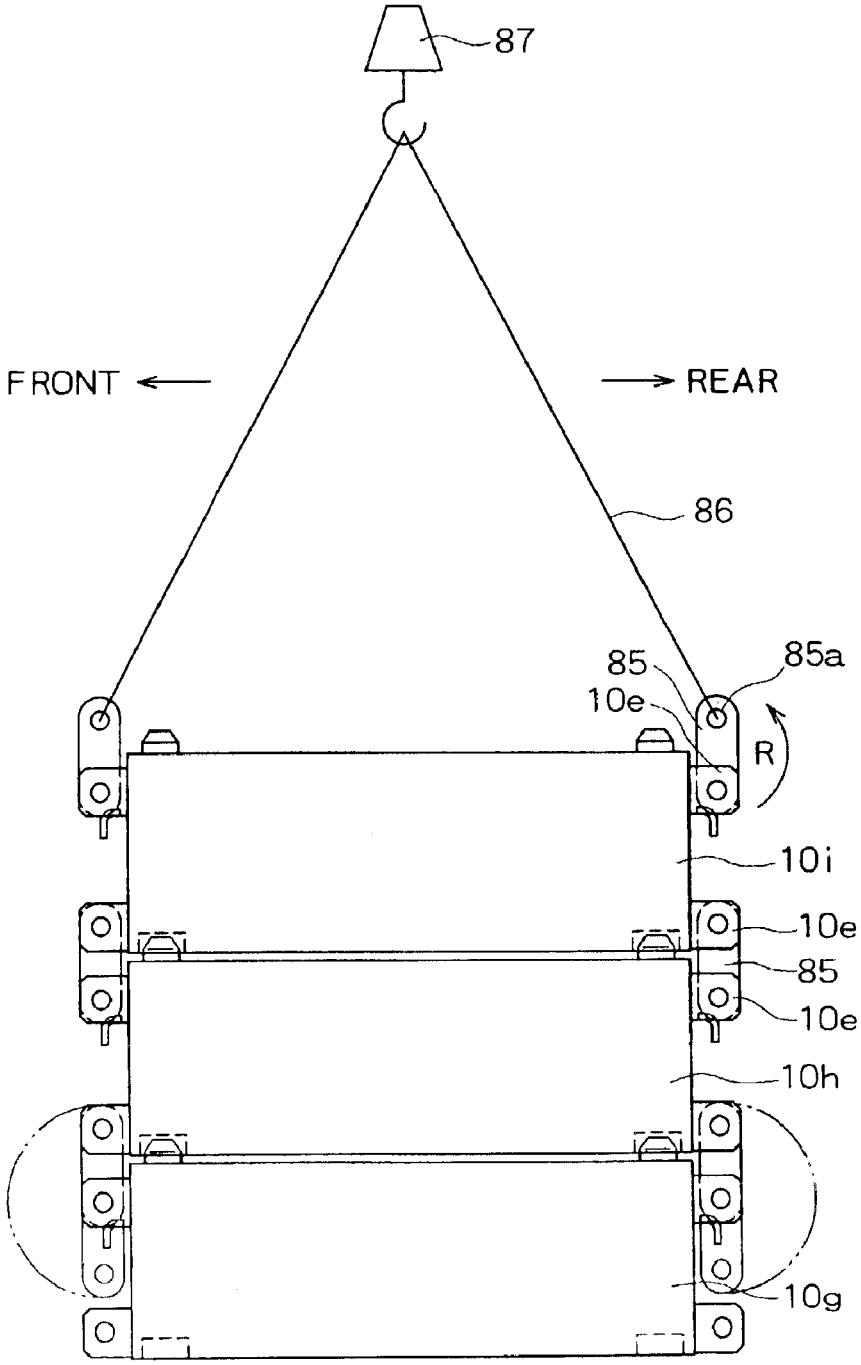
FIG. 16 is an enlarged view of a counterweight connecting part.

FIG. 16 is a front view showing the CW10 connecting portion in an enlarged scale. In the figure, in the upper and lower portions of CW of each stage, a pair of connecting fittings 10*e* provided with a through-hole is provided to be protruded. The connecting plate 85 is inserted into the space between the connecting fittings 10*e*, and pins are inserted into the through-hole of the connecting fittings 10*e* and the through-hole of the connecting plate 85 to connect the counterweights 10*g* to 10*i* of each stage.

Through-holes are formed in both ends of the connecting plate 85, and where the CWs are connected together, both the through-holes are used as pin insert holes. Since the connecting plate 85 can be rotated in a direction of arrow R, where the CW is suspended, one through-hole 85*a* can be used as a suspending ring for connecting a suspending rope. Further, when CW is transported, it can be used as a tying tool. In the figure, reference numeral 87 indicates a suspending hook.

Figure 17B:
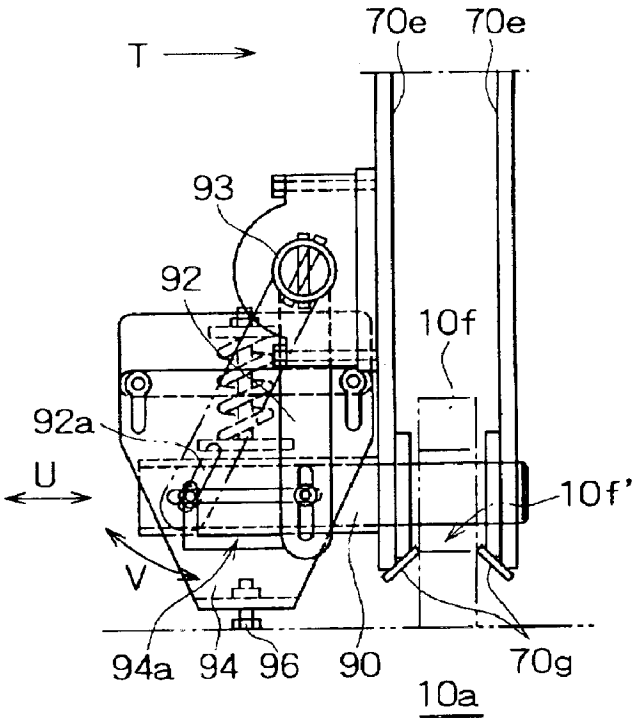
FIGS. 17A and 17B respectively show the constitution of a mooring pin device, FIG. 17A being a view taken in a direction of arrow T of FIG. 17B, FIG. 17B being a rear view thereof.
Figure 17A:
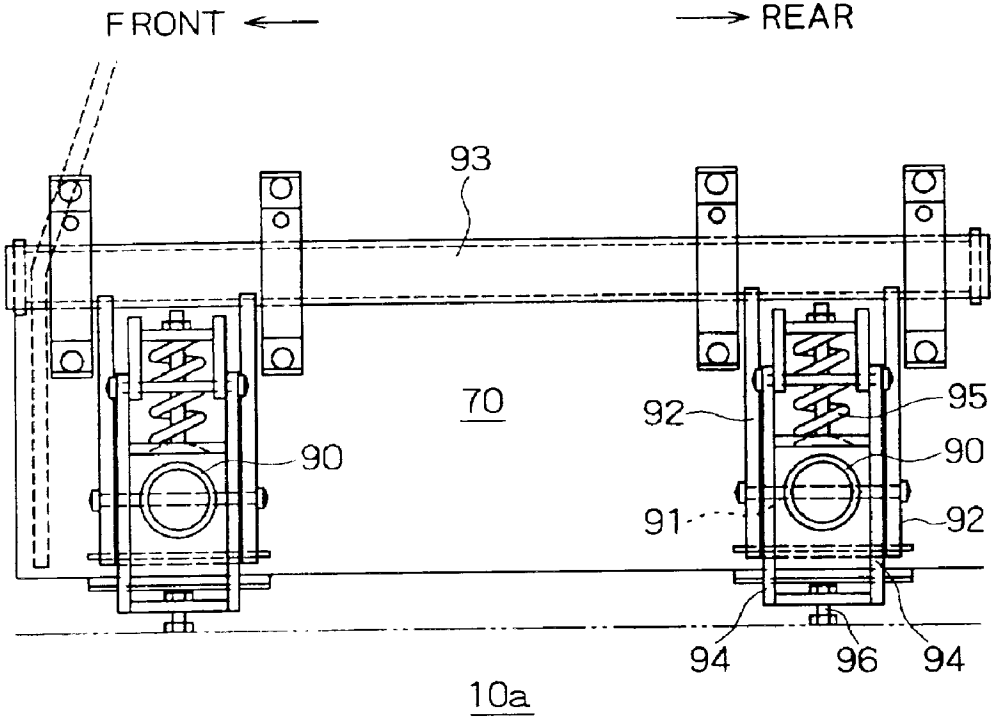

FIGS. 17A and 17B show a mooring pin device for inserting or removing a mooring pin for fixing the base 10*a* of the CW10 and the connecting bracket 70. FIG. 17B is an enlarged view of the K portion of FIG. 15. FIG. 17A is a view taken in a direction of T of FIG. 17B. In both the figures, at the lower part of the connecting bracket 70 is formed a mounting plate housing portion 70*e* formed from a parallel plate for receiving a mounting plate 10*f* when the counterweight 10 is lifted.

At the lower end of the mounting plate housing portion 70*e* is provided guide portions 70*g* and 70*g* inclined in the shape of / \ directed internally. Thereby, the mounting plate 10*f* is inserted into the mounting plate housing portion 70*e* positively and easily. A deviation widthwise at the time of inserting can be absorbed by the guide portions 70*g* and 70*g*.

The guide portions 70*g* and 70*g* provided at the lower part of the connecting bracket 70 and the suspending fitting guide 70*f* (see FIG. 10A) provided before and after on the outer surface of the side wall of the connecting bracket 70 described above function as guide means to smoothly guide the CW10 in all directions (front, rear, left and right) to a prescribed position of the connecting bracket 70 in the state of controlling oscillation.

From the foregoing, it is recommended that guide means for guiding the CW to the counterweight mounting portion as the CW moves up is provided in either of the connecting bracket or CW. In this case, in mounting the CW, positioning can be carried out simply and in a short period of time.

The mounting plate 10*f* is provided with the triangular hole 10*f'* as described above, and a mooring pin 90 is inserted into and removed from the triangular hole 10*f'*. The triangular hole 10*f'* has its top to which a load is applied is formed to be a circular arc. The side holding the top functions as a wedge so as to guide the mooring pin 90 to the top. Accordingly, when the mooring pin 90 is inserted, even if there is a minor deviation of position between a mounting plate housing portion 70*e* and the mounting plate 10*f*, the mooring pin 90 can be inserted easily. Therefore, after the mooring pin 90 has been completely inserted, the mooring pin 90 is guided by the side and held in the top of the triangular hole 10*f'*.

Two mooring pins 90 are disposed backward and forward corresponding to the triangular holes 10*f'*. A shaft 91 diametrically extends through each mooring pin 90, and both left and right ends of the shaft 91 are moved within a slot 92*a* of links 92 and 92. Each link 92, 92 is connected to a support pipe 93. When the support pipe 93 is rotated about a rotational axis X, the link 92, 92 can be oscillated in a direction of arrow V (see FIG. 17B).

The support pipe 93 is provided at the rear end thereof with a convex portion for rotational operation. A long tubular operating lever provided at the extreme end thereof with a concave portion capable of being fitted in the convex portion is connected to the support pipe 93. In this manner, inserting and removing of the mooring pin 90 can be operated from the ground. That is, fixing operation of the CW can be carried out without an operator being ridden on the CW.

Further, the mooring pin 90 is designed so that the former can be moved along a guide groove 94*a* formed in a guide plate 94, and the guide plate 94 is biased downwardly by a compression coil spring 95. The guide groove 94*a* is formed to have a shape of U. Numeral 96 denotes a contact bolt in contact with the upper surface of the CW10*a* and the length can be adjusted.

Figure 18A:
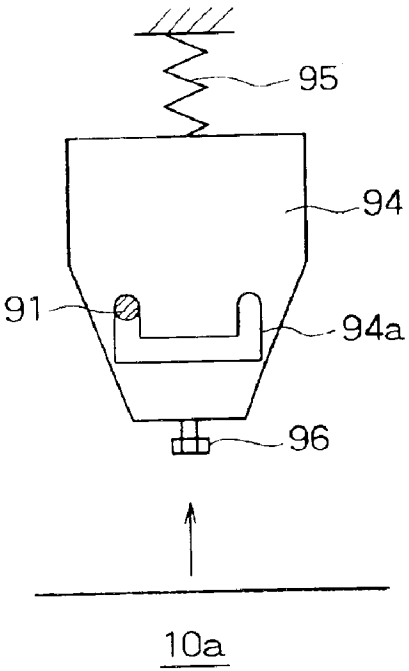
FIGS. 18A to 18C are respectively schematic views for explaining the operation of the mooring pin devices shown in FIGS. 17A and 17B.
Figure 18B:
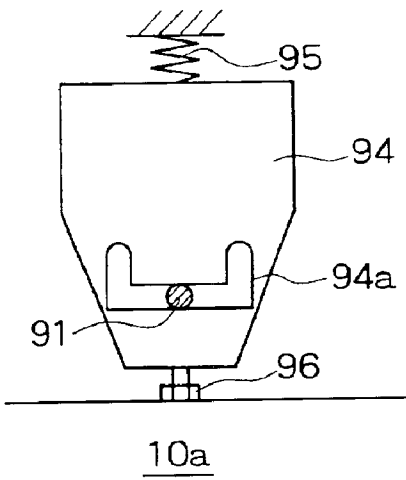
Figure 18C:
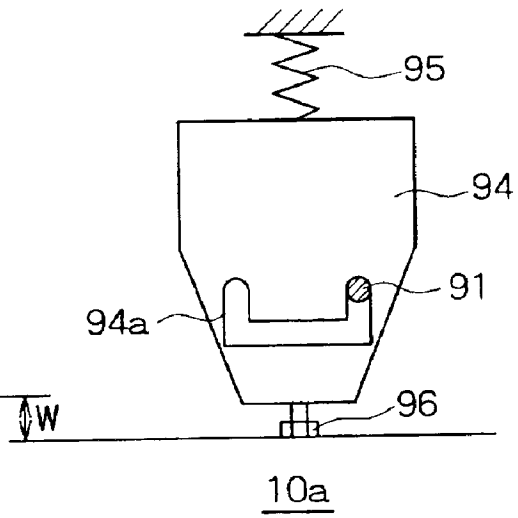

Next, operation of a mooring pin device having the above-described constitution will be explained with reference to FIG. 18.

In the figure, the guide plate 94 is pressed down by the biasing force of the compression coil spring 95 before the CW10 is lifted, and the shaft 91 is held at the upper end of a left longitudinal groove in the guide groove 94*a*. When the CW10*a* moves up into contact with the contact bolt 96, the guide plate 94 is pushed up against the biasing force, and the lateral groove is opened to the right side of the shaft 91. In this state, when the operating lever is operated to rotate the link 92 counterclockwise (see FIG. 17B), the shaft 91 can be moved rightward with the lateral groove as a guide. Thereby, the mooring pin 90 can be inserted into the triangular hole 10*f*'. When the elevating cylinders 73 and 73 are somewhat contracted after the completion of insertion of the mooring pin 90, the CW10*a* moves down by distance w, and the compression coil spring 95 is restored whereby the guide plate 94 moves down also in association with the CW10*a*. Thereby, the shaft 91 is held at the upper end of the right longitudinal groove in the guide groove 94*a*, and is locked. That is, locking can be carried out after the mooring pin 90 has been inserted.

In this manner, there is constituted a lock mechanism for automatically locking the mooring pin 90 at positions in the state where the mooring pin 90 is inserted in association with the attaching and detaching operation of the CW, and in the state where the mooring pin 90 is removed.

While in the above-described embodiment, the operating lever for inserting and removing the mooring pin was of the attaching and detaching type, it is noted that the lever may be fixed to the CW or the rear unit, and the operation may be made from the ground using a rope or the like in place of the long tubular operating lever. Furthermore, it can be designed so that a hydraulic or electric actuator is used to effect the inserting and removing operation automatically.

Further, while in the present embodiment, the wheeled crane according to the present invention is of a crawler crane, it is noted that the present invention can be applied to a wheeled crane such as a wheel crane, not limiting thereto.

Further, while in the present embodiment, the rear device according to the present invention has been explained giving examples such as a CW, a counterweight elevating device and an outrigger, there is included an independent electric power plant for supplying power to devices, for example, such as a winch, a hydraulic tag line device, and a work attachment, not limiting thereto.

Further, while in the above-described embodiment, a gantry has been used as a support body when the connecting bracket is moved up and down, there can be constituted by a mast device provided free to rise and fall on the upper rotating body, not limiting thereto, and further, an exclusive-use support arm may be provided.

Next, the counterweight self-attaching and-detaching apparatus as a rear device according to the present invention will be described in detail.

Figure 19:
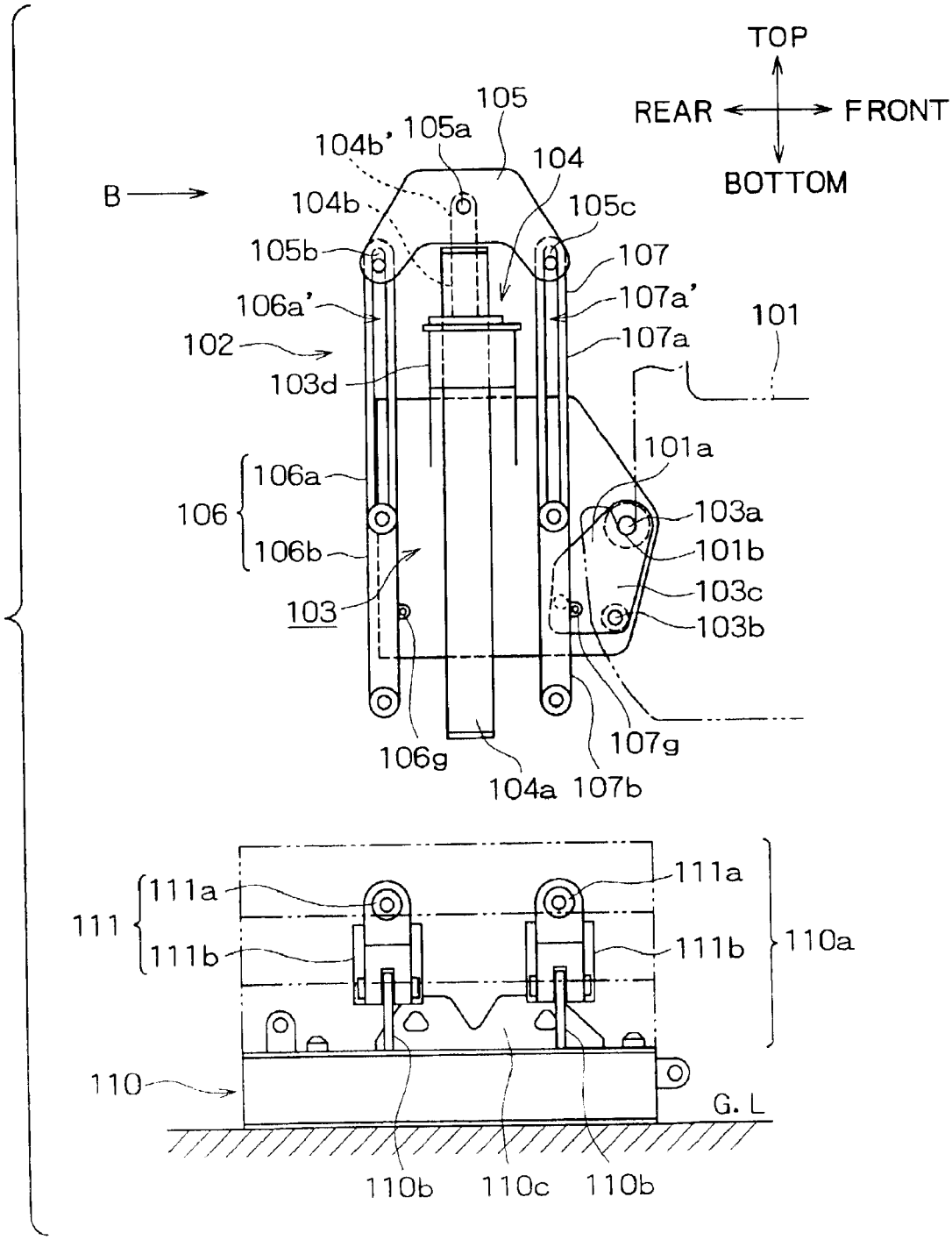
FIG. 19 is a side view showing the constitution of a counterweight self-attaching and-detaching device according to the present invention.

FIG. 19 shows one embodiment of the counterweight self-attaching and-detaching apparatus according to the present invention. In the figure, numeral 101 designates a rear part of an upper rotating body of a construction machine.

A counterweight self-attaching and-detaching apparatus (hereinafter abbreviated as a weight attaching and detaching apparatus) 102 has a boxlike bracket 103 mounted on the rear part of an upper rotating body 101. On the front side of a side plate in the bracket 103, a mounting shaft 103*a* is mounted in a direction of vehicle width, and at the lower portion of the front side of the side plate, there are provided a pin hole 103*b* for securing the bracket 103 to the rear part of an upper rotating body 101. Numeral 103*c* designates a reinforcing plate.

On the other hand, in the rear part of an upper rotating body 101 on which the bracket 103 is mounted, a pair of frames 101*a* and 101*a* (only one on this side is shown) is extended in parallel backwardly. The frames 101*a* and 101*a* are formed at the upper portion with receivers 101*b* and 101*b* for putting the mounting shaft 103*a*. Accordingly, if a pin is inserted into and fixed to the pin hole 103*b* of the bracket 103 and a pin hole (not shown) formed in a frame 101*a*, the bracket 103 put on the rear part of an upper rotating body 101 through the mounting shaft 103*a* can be fixed.

The bracket 103 is provided with two hydraulic cylinders 104 and 104 (only one on this side is shown) on both sides in a direction of vehicle width. A tube 104*a* of each hydraulic cylinder 104 is secured to the bracket 103 at a longitudinal position. Numeral 103*d* designates a connecting plate for connecting the tube 104*a* and the bracket side plate.

A balance-like connecting fitting 105 is provided on the extreme end of a rod 104*b* extended upward from the hydraulic cylinder 104. Two links are suspended from the connecting fitting 105. More specifically, connecting fitting 105 (only one on this side is shown) are provided on the extreme end 104*b*' of the rod 104*b* through a shaft 105*a*, and on both ends in a lateral direction of the connecting fitting 105, links 106 (only one on this side is shown) as a link member and links 107 (only one on this side is shown) as a link member are suspended through a pin 105*b* and a pin 105*c*, respectively.

In this case, since the CW is moved up and down while being held on the link member free from flexure or torsion, the attitude of the CW can be stabilized. Therefore, the CW can be detachably mounted on the rear part of the upper rotating body in a short period of time.

The links 106 and 107 can be oscillated laterally. Therefore, a CW110 described later can be lifted even if it is not positioned accurately in a lateral direction.

From the foregoing, it is recommended that the link members be constituted free to oscillate backward and forward. In this case, the CW which is not positioned accurately in a lateral direction can be also moved up and down.

Further, the links 106 and links 107 are arranged in parallel on both sides of the hydraulic cylinder 104, and two links are likewise suspended with respect to the hydraulic cylinder 104 on the deep side. Accordingly, as a whole, the links are to be arranged backward and forward on both left and right (in a direction of vehicle width) sides.

In the following, a description will be made of the constitution on behalf of the hydraulic cylinder 104, connecting fitting 105, links 106 and links 107.

The link 106 comprises a long upper link 106*a* and a lower link 106*b* formed to be shorter than the upper link 106*a*. The upper link 106*a* is formed with a long groove 106*a*'.

From the foregoing, it is recommended that the link member be constituted free to expand by an upper link portion and a lower link portion connected below the upper link portion, and a counterweight connecting portion is provided at the lower end of the lower link portion. In this case, at the time of mounting the CW, the lower link portion is extended to the CW placed on the ground whereby the CW can be connected, and at the time of non-attaching and-detaching operation of CW, the lower link portion can be contracted vertically by its length portion and withdrawn. Thereby, the total height of the construction machine can be lowered at the time of transportation.

Figure 20A:
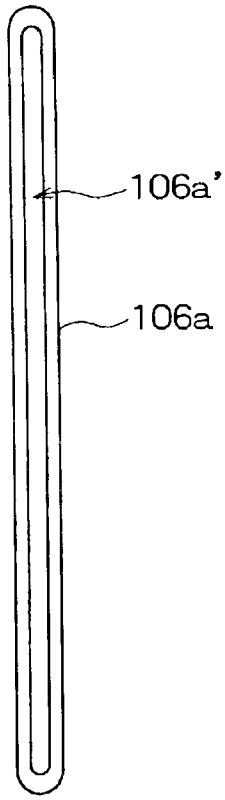
FIG. 20A is an enlarged view of an upper link shown in FIG. 19, and FIGS. 20B and 20C are respectively enlarged views of a lower link.
Figure 20B:
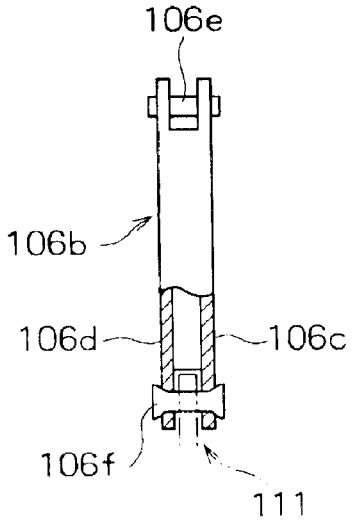
Figure 20C:
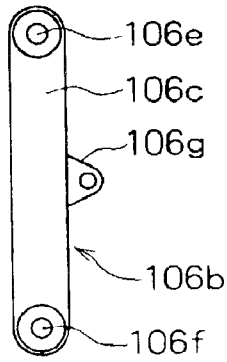

FIGS. 20A to 20C show the link 106 in an exploded form. FIG. 20A is a side view of the upper link 106*a*, FIG. 20B is a back view of the lower link 106*b*, and FIG. 20C is a side view thereof.

The lower link 106*b* has an outer plate 106*c* and an inner plate 106*d*, which have the same shape. The upper ends of both the plates 106*c* and 106*d* are connected by a connecting pin 106*e,* and the lower ends thereof are connected by a connecting pin 106*f.* Here, the connecting pin 106*e* is secured to both the plates 106*c* and 106*d* after having been inserted into a long groove 106*a*' of the upper link 106*a*. As described, the pin 105*b* of the connecting fitting 105 and the pin 106*e* of the lower link 106*b* can be moved within the long groove 106*a*' of the upper link 106*a*. Therefore, the upper links 106*a* and 107*a* can be moved up and down in association with the expansion of the hydraulic cylinder 104. Further, the upper links 106*a* and 107*a* and the lower links 106*b* and 107*b* can be expanded (see FIG. 19).

On the other hand, the connecting pin 106*f* is also inserted into connecting fitting 111 to be connected with a CW110 described later.

In the lower link 106*b,* a portion into which the connecting pin 106*f* is inserted functions as a CW connecting portion.

From the foregoing, it is recommended that the link members are arranged backward and forward on both the left and right sides, the link members backward and forward are connected together by connecting fittings, and one end of the hydraulic cylinder as elevating means is connected to the connecting fittings. In this case, the counterweight self-attaching and-detaching apparatus can be constituted in compact. Further, the link members can be moved up and down equally.

Numeral 106*g* designates a projecting element for holding the lower link 106*b* in the bracket 103. If in the state that the lower link 106*b* is moved upward, a pin is inserted into a through-hole of the projecting element 106*g,* and the pin is secured to the bracket 103, the lower link 106*b* can be held in a contracted state.

Turning back to FIG. 19, a description is made.

The link 107 has also the same constitution as the above-described link 106, has an upper link 107*a* and a lower link 107*b,* and the lower link 107*b* can be extended downward. There is also provided a projecting element 107*g* for holding the bracket 103 in the state that the lower link 107*b* is contracted.

The length necessary for the links 106 and 107 is suitably decided according to the mounting height of the bracket 103 and the stroke length of the hydraulic cylinder.

The CW110 is arranged below the weight attaching and detaching apparatus 102. As shown in the figures, in the CW110 placed on the ground, only the lowermost stage thereof is shown so that a connecting portion between the weight attaching and detaching apparatus 102 and the links 106 and 107 can be seen, but actually, a plurality of CW110*a* is accumulated on both sides in a direction of vehicle width. A pair of connecting metal fittings (suspending portion) 111 for connecting the lower link 106*b* and the lower link 107*b* is mounted in advance on the upper surface of the CW110.

Figure 21:
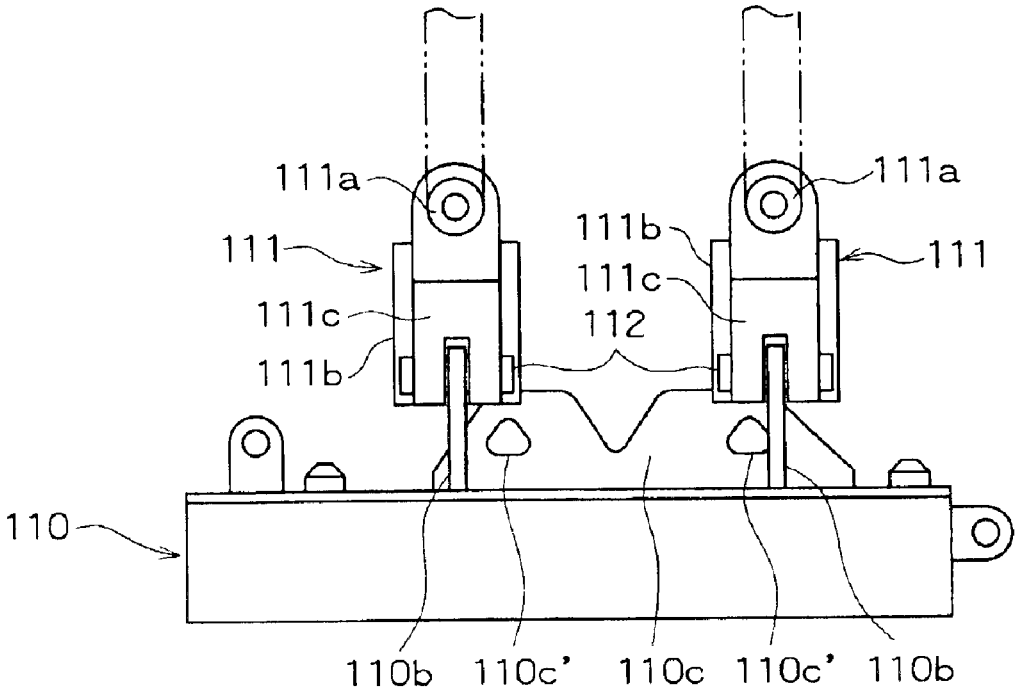
FIG. 21 is an enlarged view of a counterweight shown in FIG. 19.

In FIG. 21, the connecting metal fitting 111 has a boss portion 111*a* connected to the lower end of the lower link 106*b* through a pin 106*f.* A pair of legs 111*c* and 111*c* is suspended from the boss portion 111*a*.

Numeral 111*b* designates a guide plate provided with a tapered surface, which is provided in order to smoothly guide the connecting metal fitting 111 to a clearance of the bracket 103 when, lifting CW110. A suspending portion 110*b* projected from the CW110 is inserted into a clearance between both the legs 111*c* and 111*c,* and a pin 112 is inserted into the leg 111*c* and the suspending portion 110*b* whereby the connecting metal fitting 111 is connected to the CW110.

Further, on the upper surface of the CW110, there is formed a mounting plate 110*c* comprised of a convex element parallel in a lateral direction. In the mounting plate 110*c,* through-holes 110*c*' formed in the shape of a triangle are provided before and after so as to facilitate positioning of a pin. Therefore, if when the CW110 is lifted up to a mounting position of the rear portion of the upper rotating body 101, a pin is inserted into a through-hole 110*c*' of the mounting plate 110*c* and a through-hole (not shown) provided in the frame 101*a* and fixed, the CW110 is secured to the bracket 103.

The operation of the weight attaching and detaching apparatus having the above-described constitution will be explained with reference to FIGS. 22A to 23E.

Figure 22A:
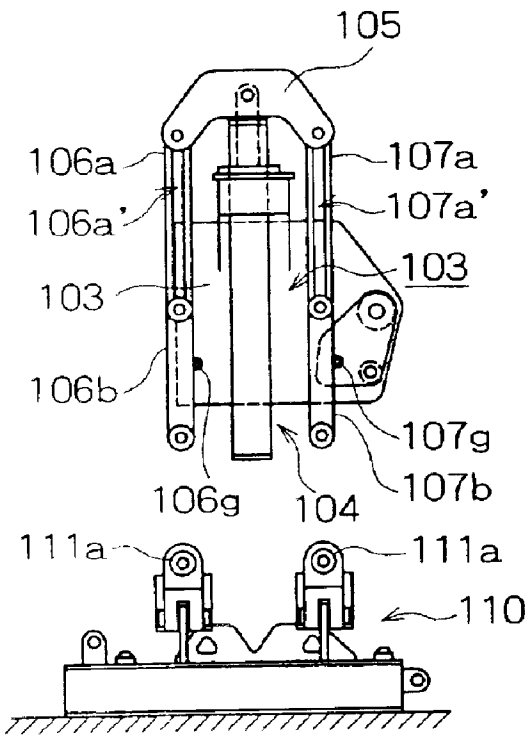
FIGS. 22A to 22F are respectively process views for explaining the counterweight mounting operation.
Figure 22B:
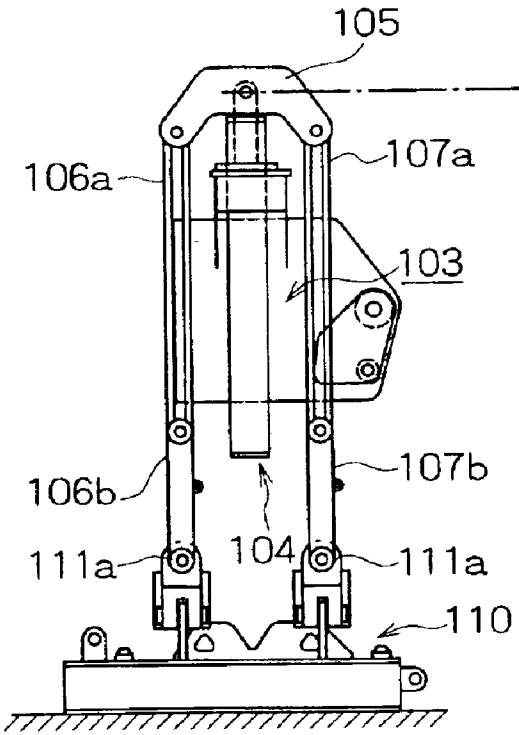
Figure 22C:
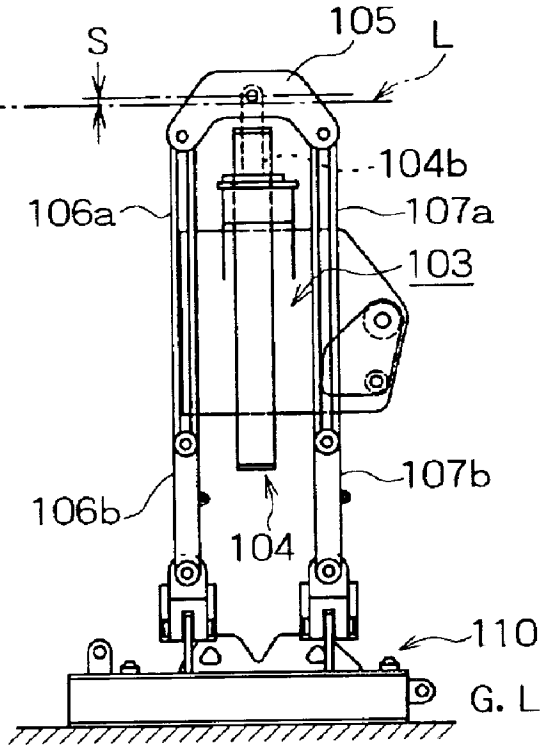

FIGS. 22A to 22F show the operation of mounting a counterweight. In FIGS. 22A to 22C, it is assumed that the hydraulic cylinder 104 is in a contracted state.

In FIG. 22A, first, the pin for fixing the projecting elements 106*g* and 107*g* of the lower links 106*b* and 107*b* to the bracket 103 is removed. The fixing between the lower links 106*b* and 107*b* is released, and both the links 106*b* and 107*b* move down along the long grooves 106*a*' and 107*a*' of the upper links 106*a* and 107*a*.

In FIG. 22B, the lower links 106*b* and 107*b* moved down are connected to the connecting metal fitting 111 connected to the suspending portion of the CW110. More specifically, the boss portions 111*a* and 111*a* of the connecting metal fitting 111 and the lower ends of the lower links 106*b* and 107*b* are connected by the pin.

In FIG. 22C, a piston rod 104*b* is extended to extend a surplus stroke S (L is a center of an extreme end of a rod in the most contracted state), and raising of the counterweight 110 is started.

Figures 22D, 22E, 22F:
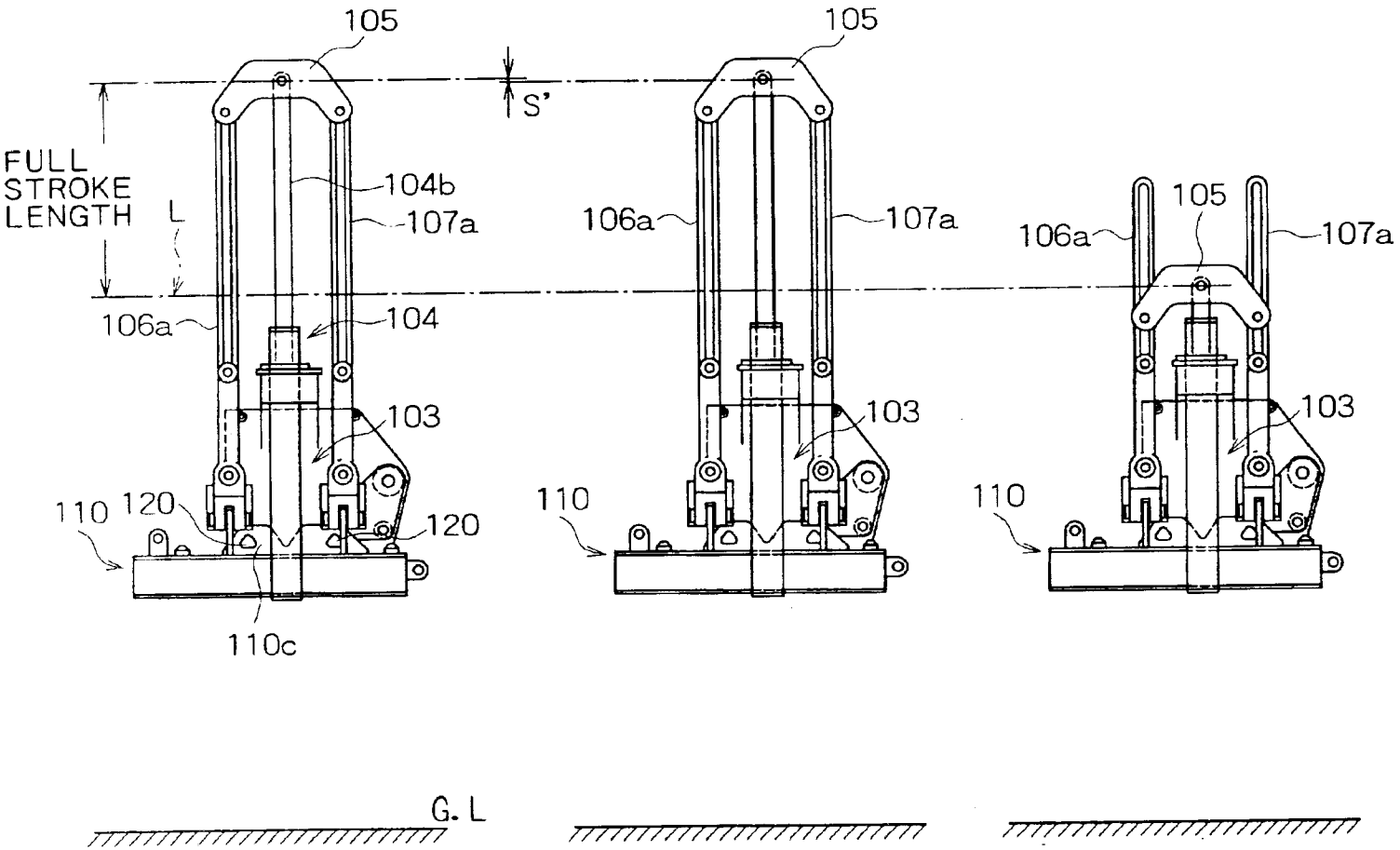

In FIG. 22D, after the hydraulic cylinder 104 has been extended to a full stroke mode, a fixing pin 120 is inserted into a mounting plate 110*c* and a frame 101*a* (see FIG. 19) and fixed. The fixing pins 120 are mounted at two places of the mounting plates 110*c,* to a total of four places.

In FIG. 22E, the hydraulic cylinder 104 is somewhat relieved (in the figure, see S') from the full stroke mode, and the CW110 is held on the bracket 103.

In FIG. 22F, the hydraulic cylinder 104 is contracted to the most contracted state, and a backlash preventive bolt (not shown) which extends downward from the bracket 103 to prevent a backlash of the CW is mounted to complete mounting of the CW110.

FIGS. 23A to 23E show the operation of removing a CW. It is assumed that the hydraulic cylinder 104 is in the most contracted state.

Figure 23A:
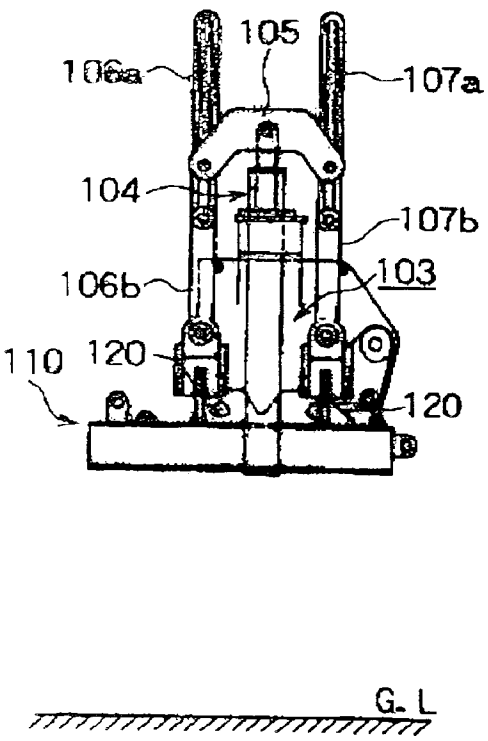
FIGS. 23A to 23E are respectively process views for explaining the counterweight removing operation according to the present invention.

In FIG. 23A, the backlash preventive bolt is removed.

Figure 23B:
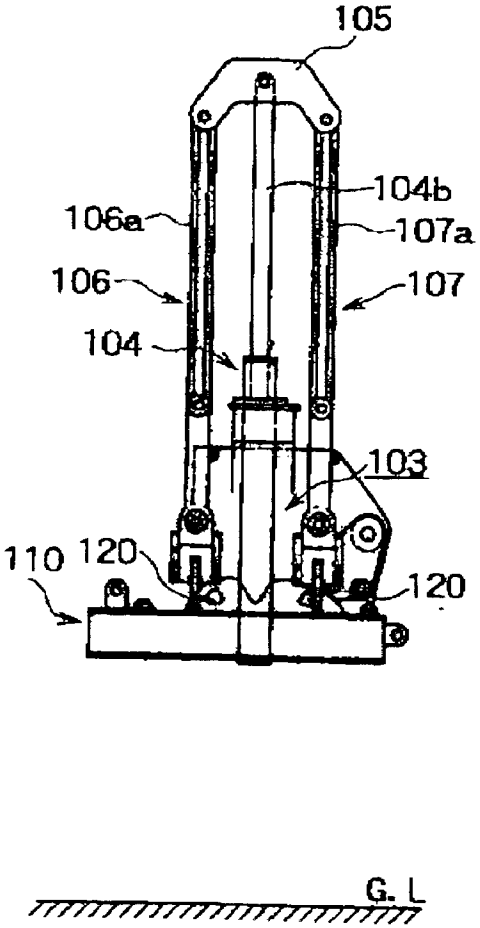

In FIG. 23B, the hydraulic cylinder 104 is extended to the full stroke mode, and then, the fixing pins 120 being fixed at four places are removed.

Figure 23C:
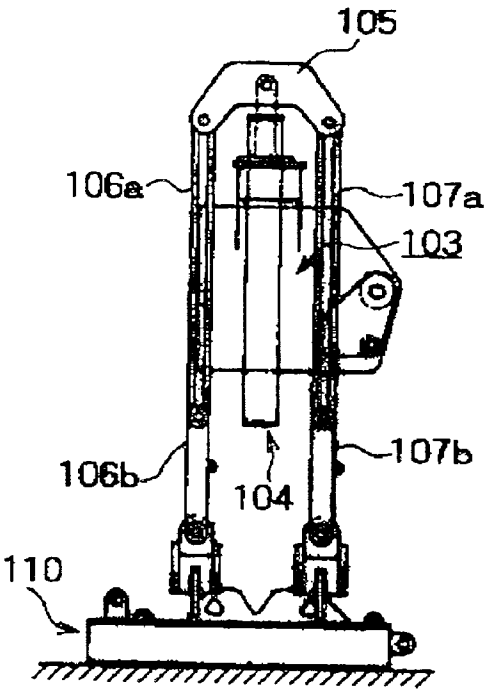

In FIG. 23C, the piston rod 104*b* of the hydraulic cylinder 104 is contracted to thereby move down the CW110.

Figure 23E:
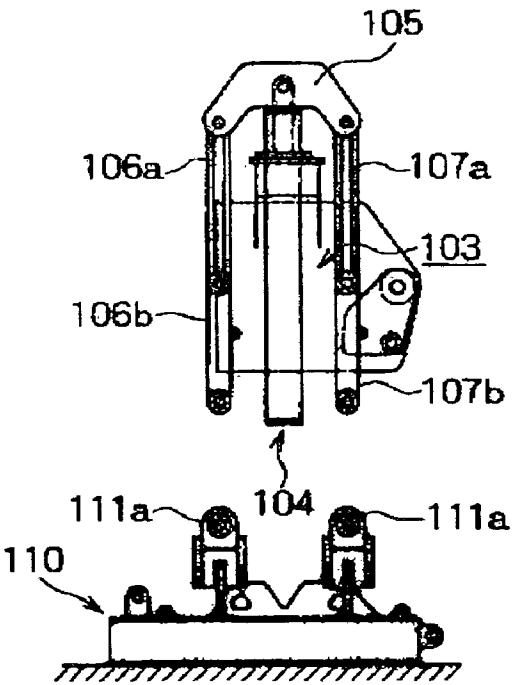
Figure 23D:
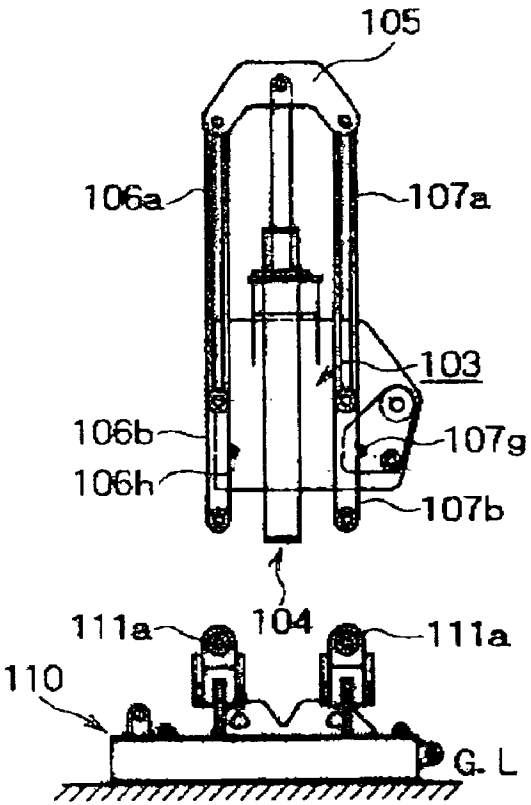

In FIG. 23D, after the CW110 has been separated from the lower links 106*b* and 107*b,* the hydraulic cylinder 104 is extended. Thereby, the projecting elements 106*g* and 107*g* of the lower links 106*b* and 107*b* are moved up to its fixing position, and are fixed to the bracket 103 at a fixing position.

In FIG. 23E, the hydraulic cylinder 104 is contracted to complete removing of the counterweight 110.

While in the above-described embodiment, the lower links 106*b* and 107*b* are extended from the upper links 106*a* and 107*a* so as to access to the suspending portion of the CW110, there can be constituted by a single rink having a length which results from addition of lengths of the upper link 106*a* and the lower link 106*b*. Further, if links comprising two stages or above, for example, links comprising three stages are expanded, or joints comprising three stages are folded, the amount of upward projection of the link member when the weight attaching and detaching apparatus is mounted on the upper rotating body can be reduced.

Further, where the suspending portion of the CW projects from the upper surface of the CW accumulated in a multistage, the CW10 can be raised or lowered directly merely by the upper links 106*a* and 107*a*.

Further, with respect to the lower links 106*b* and 107*b*, a long groove similar to that of the upper link can be provided for the purpose of reducing weight.

Further, while in the above-described embodiment, a pair of left and right hydraulic cylinders 104 is arranged, a single hydraulic cylinder 104 may be arranged in the intermediate position between the left and right links. The arrangement of the links 106 and 107 is decided corresponding to the direction of the boss portion 111*a* of the connecting metal fitting 111.

While one embodiment of the present invention has been disclosed above, the scope of protection of the present invention is not limited thereto. Equivalents which exhibit operation and effect of the present invention are included in the scope of protection of the present invention.

We claim:

1. A construction machine, comprising:

a lower traveling body;

an upper rotating body pivotedly mounted on said lower traveling body, said upper rotating body having a rotating frame;

a counterweight elevating device; and a connecting bracket detachably mountable on a rear end of said rotating frame, said connecting bracket having mounting means for detachably and immovably mounting a rear device including a counterweight to the connecting bracket, and a connecting portion for detachably connecting said connecting bracket to the rear end of said rotating frame, wherein said counterweight elevating device is detachably mountable to said connecting bracket independently of said rotating frame.

2. The construction machine according to claim 1, wherein said connecting bracket has a counterweight mounting portion for mounting the counterweight as said rear device.

3. The construction machine according to claim 2, further comprising:

a mooring member of said counterweight mounting portion provided corresponding to an engaging hole for connecting with said connecting bracket in said counterweight; and a link mechanism for inserting or removing said mooring member from said engaging hole.

4. The construction machine according to claim 2, further comprising:

guide means provided on either said connecting bracket or said counterweight, said guide means adapted to guide said counterweight to said counterweight mounting means as said counterweight is moved up.

5. The construction machine according to claim 1, wherein said connecting bracket has a mounting portion for mounting said counterweight elevating means having an expansion cylinder.

6. The construction machine according to claim 5, further comprising;

a support body projected from the rear end of said rotating frame toward backward of the construction machine, said support body having a portion to be engaged for engaging said expansion cylinder, wherein in a state that one end of said expansion cylinder is engaged with said portion to be engaged, said expansion cylinder is expanded or contracted whereby the connecting bracket with said counterweight elevating device can be moved up and down by own efforts.

7. The construction machine according to claim 6, wherein said support body comprises a gantry for raising and lowering a boom provided on said upper rotating body.

8. The construction machine according to claim 1, further comprising:

an engaging body provided at an end on a rotating frame side in said connecting bracket, said engaging body being provided at the rear end of said rotating frame, and engaging a portion to be engaged for engaging said connecting bracket.

9. The construction machine according to claim 1, further comprising:

a link member provided vertically movable on said connecting bracket, said link member having at its lower end a counterweight connecting portion for connecting a suspending portion of said counterweight; and link member elevating means adapted to elevate said link member.

10. The construction machine according to claim 9, wherein said link member is constituted expandable by an upper link portion and a lower link portion connected to a lower part of said upper link portion, said counterweight connecting portion being provided at a lower end of said lower link portion.

11. The construction machine according to claim 9, wherein said link member is constituted by a pair of right and left link members through connecting fittings, said connecting fittings being connected to one end of a hydraulic cylinder as said link member elevating means.

12. The construction machine according to claim 9, wherein said link member is constituted capable of oscillating laterally.

13. The construction machine according to claim 9, wherein said counterweight elevating means has a cylinder for expansion and contraction.

14. A self-attaching and-detaching method of the construction machine of claim 13, comprising the steps of:

connecting an upper end of said cylinder in the construction machine and said counterweight by the link member;

extending said cylinder to thereby move said counterweight up to said mounting means in said connecting bracket through said link member; and connecting said counterweight to said connecting bracket through said mounting means.

15. A self-attaching and-detaching method of a construction machine, comprising the steps of:

connecting an upper end of a counterweight elevating device with a counterweight by a link member, wherein said counterweight elevating device is mounted to a connecting bracket detachably mounted on a rear end of a rotating frame of the construction machine independently of said rotating frame;

extending said counterweight elevating device to thereby lift said counterweight, via said link member, up to a mounting portion of said connecting bracket; and connecting said counterweight to said connecting bracket through said mounting portion.

* * * * *